US006359563B1

(12) United States Patent
Herzer

(10) Patent No.: US 6,359,563 B1
(45) Date of Patent: Mar. 19, 2002

(54) 'MAGNETO-ACOUSTIC MARKER FOR ELECTRONIC ARTICLE SURVEILLANCE HAVING REDUCED SIZE AND HIGH SIGNAL AMPLITUDE'

(75) Inventor: Giselher Herzer, Bruchkoebel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/247,688

(22) Filed: Feb. 10, 1999

(51) Int. Cl.[7] ..... G08B 13/14

(52) U.S. Cl. ..... 340/572.6; 340/572.1; 148/108

(58) Field of Search ..... 340/572.6, 551, 340/572.1, 561, 567, 568.1; 148/108, 122, 121, 304, 310, 120

(56) References Cited

U.S. PATENT DOCUMENTS 4,510,490 A 4/1985 Anderson, III et al. ..... 340/572
5,469,140 A * 11/1995 Liu et al. ..... 340/551
5,650,023 A * 7/1997 Hasegawa et al. ..... 148/304
6,011,475 A * 1/2000 Herzer ..... 340/572.6
6,057,766 A * 5/2000 O'Handley et al. ..... 340/572.6
6,254,695 B1 * 7/2001 Herzer et al. ..... 148/108

* cited by examiner

*Primary Examiner*—Anh La
(74) *Attorney, Agent, or Firm*—Schiff Hardin & Waite

(57) ABSTRACT

A resonator, having a width no larger than about 13 mm, for use in a marker containing a bias element which produces a bias magnetic field in a magnetomechanical electronic article surveillance system is produced from annealed ferromagnetic ribbon having a basic composition $Fe_aCo_bNi_cSi_xB_yM_z$ wherein a, b, c, x, y and z are in at %, wherein M is one or more glass formation promoting elements and/or one or more transition metals, and wherein $15 \leqq a \leqq 30$, $6 \leqq b \leqq 18$, $27 \leqq c \leqq 55$, $0 \leqq x \leqq 10$, $10 \leqq y \leqq 25$, $0 \leqq z \leqq 5$, $14 \leqq x+y+z \leqq 25$, such that $a+b+c+x+y+z=100$. The ferromagnetic ribbon is annealed in a magnetic field oriented perpendicularly to the ribbon axis and/or while applying a tensile stress to the ribbon along the ribbon axis. Single resonator or multiple resonator assemblies can be formed by cutting elements from the annealed ribbon. If multiple resonators are formed, the elements are placed in registration. The resulting narrow (6 mm wide) resonator has properties comparable to the properties of wider resonators, such as the conventional 12.7 mm wide resonator.

49 Claims, 6 Drawing Sheets

FIG. 9
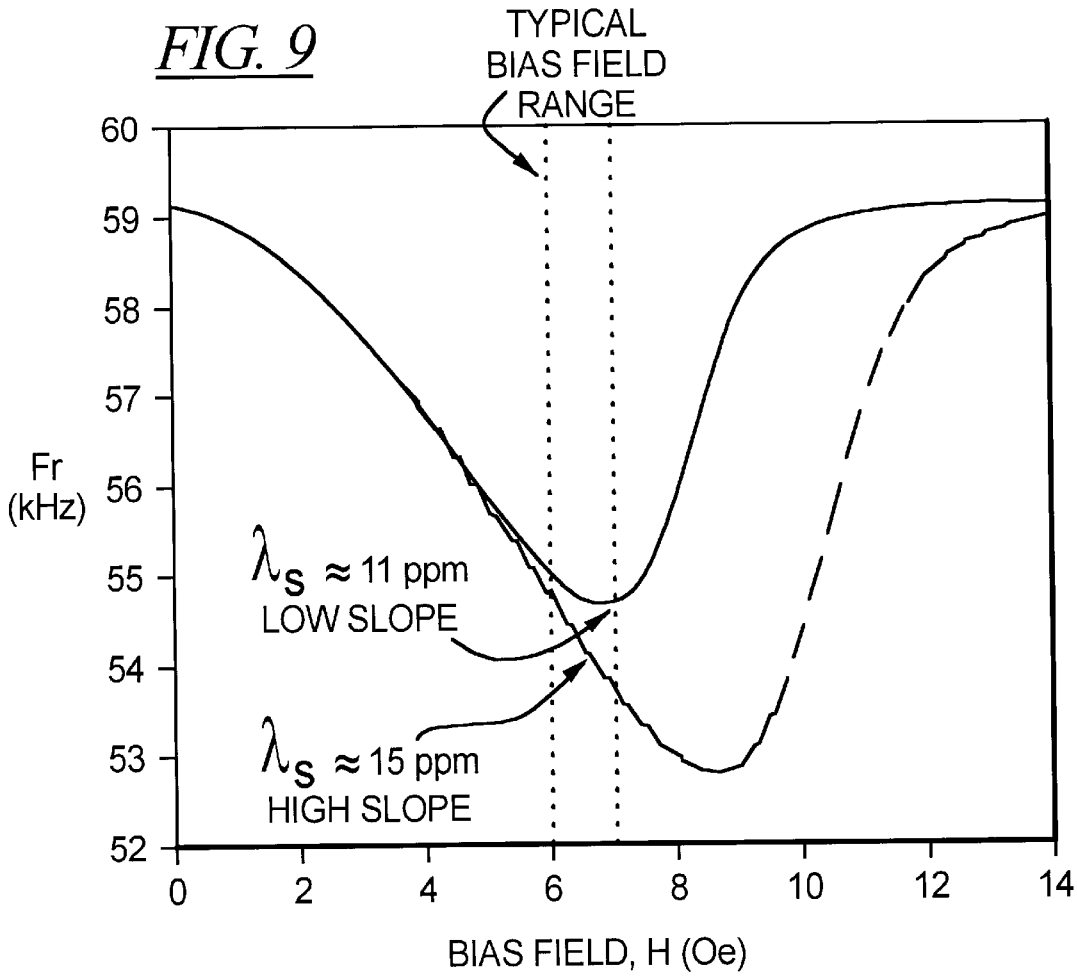
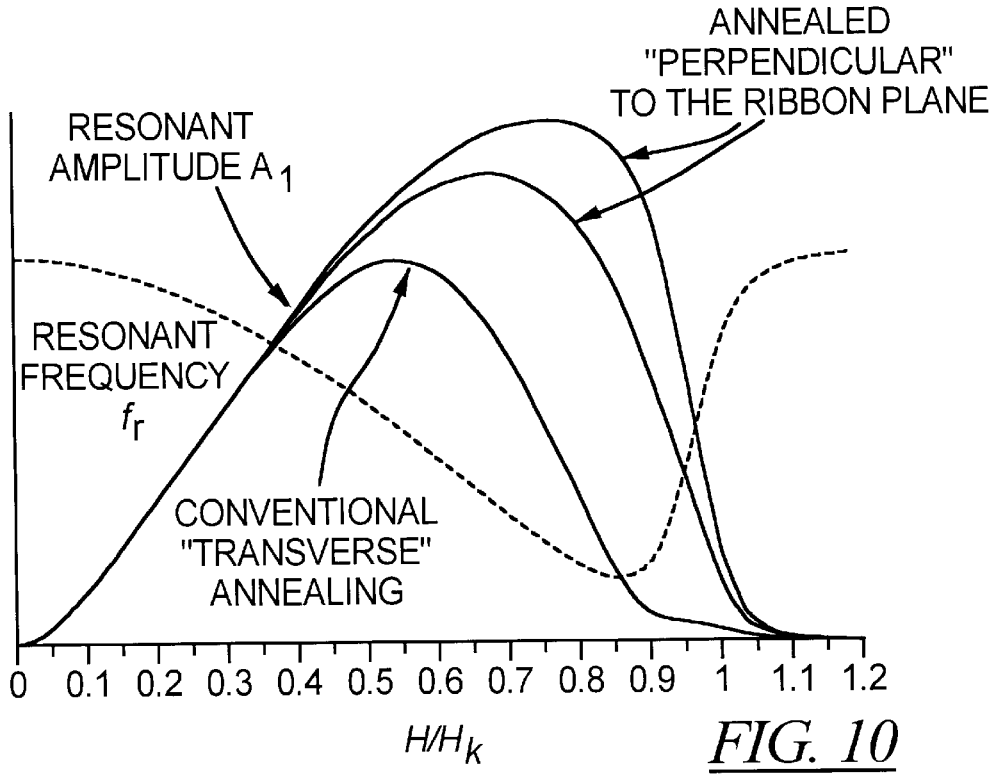
FIG. 10

'MAGNETO-ACOUSTIC MARKER FOR ELECTRONIC ARTICLE SURVEILLANCE HAVING REDUCED SIZE AND HIGH SIGNAL AMPLITUDE'

BACKGROUND OF THE INVENTION

1. Field of the Invention

The present invention is directed to a magneto-acoustic marker for use in an electronic article surveillance system, as well as to an electronic article surveillance system employing such a magneto-acoustic marker, and to a method for making such a magneto-acoustic marker.

2. Description of the Prior Art and Related Applications

Magneto-acoustic markers for electronic article surveillance (EAS) typically include an elongated trip of a magnetostrictive amorphous alloy which is magnetically biased by an adjacent strip of a magnetically semi-hard metal strip.

The typical requirements for such EAS markers are: a consistent resonant frequency at a given bias field which is primarily determined by appropriate choice of the length of the resonator, a linear hysteresis loop in order to avoid interference with harmonic systems, which is achieved by annealing the amorphous ribbon in a magnetic field perpendicular to the long axis of the resonator, a low sensitivity of the resonant frequency to the bias field, a reliable deactivability of the marker when the bias field is removed, and a (preferably) high resonant amplitude which persists for a sufficient time when the exciting drive field is removed.

Such resonators can be realized by choosing an amorphous Fe-Co-Ni-Si-B alloy which has been annealed in the presence of a magnetic field applied perpendicularly to the ribbon axis and/or a tensile stress applied along the ribbon axis. The annealing is preferably done reel to reel with typical annealing times of a few seconds at temperatures between about 300° C. and 420° C. Thereafter the ribbon is cut to oblong pieces which form the resonators. Such resonators, and a general background description of the physics and prior art relating to magneto-acoustic markers, are described in co-pending U.S. application Ser. No. 08/890,612 ("Amorphous Magnetostrictive Alloy with Low Cobalt Content and Method for Annealing Same," G. Herzer), filed Jul. 9, 1997 and co-pending U.S. application Ser. No. 08/968,653 ("Method of Annealing Amorphous Ribbons and Marker for Electronic Article Surveillance," G. Herzer) filed Nov. 2, 1997. Both of these co-pending applications as assigned to the same assignee (Vacuumschmelze GmbH) as the present application, and the teachings of both of these co-pending applications are incorporated herein by reference.

Typical markers for EAS use a single resonator which is about 38 mm long, about 25 $\mu$m and about 12.7 mm or 6 mm wide. The wider marker generally produces about twice the signal amplitude of the narrower marker, however, the narrower marker is more desirable because of its smaller size. A magnetostrictive marker employing two or more elongated strips of magnetostrictive ferromagnetic material, however, is described in U.S. Pat. No. 4,510,490. In the marker described therein, the strips are disposed side-by-side in a housing. The reason for using multiple resonator strips in this known marker is stated in the reference to be for the purpose of allowing the marker (i.e., the respective multiple strips thereof) to resonate at different frequencies, thereby providing the marker with a particular signal identity.

SUMMARY OF THE INVENTION

It is an object of the present invention is to provide a magneto-acoustic marker having reduced dimensions without degradation in performance.

More specifically it is an object of the present invention to provide a magnetostrictive amorphous metal alloy for incorporation in such a marker in a magnetomechanical surveillance system which can be cut into oblong, ductile, magnetostrictive strips which can be activated and deactivated by applying or removing a pre-magnetization field H and which in the activated condition can be excited by an alternating magnetic field so as to exhibit longitudinal, mechanical resonance oscillations at a resonance frequency $F_r$ which, after excitation, are of high signal amplitude.

It is a further object of the present invention to provide such an alloy wherein only a slight change in the resonant frequency occurs given a change in the bias field, but wherein the resonant frequency changes significantly when the marker resonator is switched from an activated condition to a deactivated condition.

Another object of the present invention is to provide such an alloy which, when incorporated in a marker for magnetomechanical surveillance system, does not trigger an alarm in a harmonic surveillance system.

It is also an object of the present invention to provide a marker embodying such a resonator, and a method for making a marker suitable for use in a magnetomechanical surveillance system.

It is finally an object of the present invention to provide a magnetomechanical electronic article surveillance system which is operable with a marker having a resonator composed of such an amorphous magnetostrictive alloy.

The above objects are achieved in a method for making a magneto-acoustic EAS marker wherein two (or more) short oblong pieces of a narrow amorphous ribbon are disposed in registration in a housing to form a dual (multiple) resonator, with the respective resonant frequencies of the individual resonator pieces coinciding to within about +/−500 Hz and preferably within +/−300 Hz. This can be achieved by giving these pieces the same length and width, the same composition and the same annealing treatment. As a consequence it is advantageous to put two (or more) consecutively cut pieces (cut to the same length) together. Such an inventive magnetoelastic marker is capable of producing a resonant signal amplitude comparable to a conventional magnetoelastic marker of the prior art of about twice the width.

As used herein, placing the pieces "in registration" means that the pieces are disposed one over the other with a substantial overlap, if not exact congruency. In any event, the term is intended to preclude a side-by-side arrangement as in the prior art.

For a dual resonator it is advantageous to choose an Fe-Ni-Co-base alloy with an iron content of more than about 15 at % and less than about 30 at % which is annealed in the presence of a magnetic field perpendicular to the ribbon axis and/or with a tensile stress applied along the ribbon axis. A generalized formula for the alloy compositions which, when annealed as described above, produces a dual resonator having suitable properties for use in a marker in a electronic article surveillance or identification system, is as follows:

$$Fe_aCo_bNi_cSi_xB_yM_z$$

wherein a, b, c, x, y and z are in at %, wherein M is one or more glass formation promoting elements such as C, P, Ge, Nb, Ta and/or Mo and/or one or more transition metals such as Cr and/or Mn and wherein $15 \leqq a \leqq 30$ $6 \leqq b \leqq 18$ $27 \leqq c \leqq 55$ $0 \leqq x \leqq 10$ $10 \leqq y \leqq 25$ $0 \leqq z \leqq 5$ $14 \leqq x+y+z \leqq 25$ such that a+b+c+x+y+z=100.

In a preferred embodiment the resonator assembly consists of two ribbon pieces in registration, each ribbon piece having a thickness between about 20 $\mu$m and 30 $\mu$m, a width of about 4 to 8 mm and a length between about 35 mm to 40 mm.

The objects of the invention can then be realized in a particularly advantageous way by using the following refined ranges in the above formula $20 \leqq a \leqq 28$ $6 \leqq b \leqq 14$ $40 \leqq c \leqq 55$ $0.5 \leqq x \leqq 5$ $12 \leqq y \leqq 18$ $0 \leqq z \leqq 2$ $15 < x+y+z < 20$ such that a+b+c+x+y+z=100.

Examples for such alloys which are particularly suitable for a dual resonator which is about 6 mm wide and in a range between 35 mm to 40 mm in length are as follows. Suitable alloys which have been tested are represented by alloys Nos. 3 through 9 in Table I, namely $Fe_{24}Co_{12.5}Ni_{45.5}Si_2B_{16}$, $Fe_{24}Co_{12.5}Ni_{44.5}Si_2B_{17}$, $Fe_{24}Co_{13}Ni_{45.5}Si_{1.5}B_{16}$, $Fe_{24}Co_{12}Ni_{46.5}Si_{1.5}B_{16}$, $Fe_{24}Co_{11.5}B_{16}$, $Fe_{24}Co_{11}Ni_{48}Si_1B_{16}$ and $Fe_{27}Co_{10}Ni_{45}Si_2B_{16}$. Various further compositions were tested in order to optimize the silicon and boron content in compositions having an iron content of 24 at %. Examples of these further compositions are $Fe_{24}Co_{12.5}Ni_{45}Si_{1.5}B_{17}$, $Fe_{24}Co_{12.5}Ni_{45}Si_2B_{16.5}$, $Fe_{24}Co_{12.5}Ni_{45}Si_{2.5}B_{16}$, $Fe_{24}Co_{11.5}Ni_{46.5}Si_{1.5}B_{16.5}$, $Fe_{24}Co_{11.5}Ni_{46.5}Si_2B_{16}$ and $Fe_{24}Co_{11.5}Ni_{46.5}Si_{2.5}B_{15.5}$. Similar compositions were also tested wherein the boron content was modified by about +/−1 at % (starting from one of the above various further alloys) at the expense of the nickel content. If annealing is performed without tensile stress, a composition with a boron content which is lower by about 0.5 to 1 at % is more suitable.

Based on the above investigations, a preferred composition is $Fe_{24}Co_{11.5}Ni_{46.5}Si_{1.5}B_{16.5}$, with $J_s$=0.86T.

If the iron content is not held at 24 at %, other particularly suited compositions are $Fe_{25}Co_{10}Ni_{47}Si_2B_{16}$ and $Fe_{22}Co_{10}Ni_{50}Si_2B_{16}$. Lastly, from a mathematical analysis of the above samples and other experimental data, the following (and similar) alloy compositions are expected to be particularly suitable as well: $Fe_{22}Co_{12.5}Ni_{47.5}Si_2B_{16}$, $Fe_{24}Co_{10.5}Ni_{48}Si_2B_{15.5}$, $Fe_{24}Co_{9.5}Ni_{49.5}Si_{1.5}B_{15.5}$ and $Fe_{24}Co_{8.5}Ni_{51}Si_1B_{15.5}$. These alloys would be particularly suited because the cobalt content is further reduced, cobalt being the most expensive component of these alloys.

Based on the above investigations, an even further refined formula can be empirically deduced, which still falls within the above-cited, more general formulae. This further refined formula is as follows:

$$Fe_{24-r}Co_{12.5-w}Ni_{45+r+v+1.5w}Si_{2+u}B_{16.5-u-v-0.5}$$

wherein r=4 to 4 at %, u=−1 to 1, v=−1 to 1 and w=−1 to 4 at %.

With such alloy compositions, suitable magneto-acoustic properties can, for example, be achieved by continuously annealing (reel to reel process) in the presence of a magnetic field of at least about 800 Oe oriented perpendicularly to the ribbon axis and a tensile stress of about 50 MPa to 150 MPa with an annealing speed of about 15 m/min to 50 m/min and a annealing temperature ranging from about 300° C. to about 400° C. The annealing process results in a hysteresis loop which is linear up to the magnetic field where the magnetic alloy is saturated ferromagnetically. As a consequence, when excited in an alternating field the material produces virtually no harmonics and, thus, does not trigger alarm in a harmonic surveillance system.

Preferably the magnetic field during annealing is applied substantially perpendicular to the ribbon plane and has a strength of at least about 2000 Oe. This results in a fine domain structure with domain width smaller than the ribbon thickness and a resonant amplitude which is at least 10% higher than that of conventionally (transverse field) annealed ribbons.

Particular suitable alloy compositions have a saturation magnetostriction between about 8 ppm and 14 ppm and when annealed as described above, the hysteresis loop of the pieces put together to form the resonator assembly has an effective anisotropy field $H_k$ between about 8 Oe and 12 Oe. Such anisotropy field strengths are low enough to provide the advantage that the maximum resonant amplitude occurs at a bias field smaller than about 8 Oe which e.g. reduces the material cost for the bias magnet and avoids magnetic clamping. On the other hand such anisotropy fields are high enough such that the active resonators exhibit only a relatively slight change in the resonant frequency $F_r$ given a change in the magnetization field strength i.e. $|dF/_r dH| < 750$ Hz/Oe but at the same time the resonant frequency $F_r$ changes significantly, by at least about 1.6 kHz, when the marker resonator is switched from an activated condition to a deactivated condition.

Usually an alloy ribbon optimized for a multiple resonator tag is unsuitable for a single resonator marker, and vice versa. By appropriate choice of alloy composition and heat treatment, however it is possible to provide an annealed alloy ribbon which is suitable for both a single and a dual resonator. Particular suitable alloys for this purpose have a saturation magnetostriction of about 10 ppm to 12 ppm and are annealed such that the anisotropy field $H_k$ of the dual resonator is about 9 to 11 Oe. This object can be realized in a particularly advantageous way by applying the following ranges to the above formula:

$22 \leqq a \leqq 26$ $8 \leqq b \leqq 14$ $44 \leqq c \leqq 52$ $0.5 \leqq x \leqq 5$ $12 \leqq y \leqq 18$ $0 \leqq z \leqq 2$ $15 < x+y+z < 20$ Examples of alloys which are particularly suitable for single and/or dual resonator having a width of about 6 mm and a length in a range between 35 mm to 40 mm are as follows. These alloys include alloy nos. 3 through 8 from Table I, namely $Fe_{24}Co_{12.5}Ni_{45.5}Si_2B_{16}$, $Fe_{24}Co_{12.5}Ni_{44.5}Si_2B_{17}$, $Fe_{24}Co_{13}Ni_{45.5}Si_{1.5}B_{16}$, $Fe_{24}Co_{12}Ni_{46.5}Si_{1.5}B_{16}$, $Fe_{24}Co_{11.5}Ni_{47}Si_{1.5}B_{16}$ and $Fe_{24}Co_{11}Ni_{48}Si_1B_{16}$. The following further compositions are also particularly suited for a dual and/or single resonator: $Fe_{24}Co_{13}Ni_{45.5}Si_{1.5}B_{16}$, $Fe_{24}Co_{12.5}Ni_{45}Si_{1.5}B_{17}$, $Fe_{24}Co_{12.5}Ni_{45}Si_2B_{16.5}$, $Fe_{24}Co_{12.5}Ni_{45}Si_{12.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$ and $Fe_{25}Co_{10}Ni_{47}Si_2B_{16}$.

A more refined formula based on the above examples for an alloy particularly suited for a dual and/or single resonator is $$Fe_{24-r}Co_{12.5-w}Ni_{45+r+v+1.5w}Si_{2+u}B_{16.5-u-v-0.5w}$$

wherein r=−1 to 1 at %, u=−1 to 1, v=−1 to 1 and w=−1 to 4 at %.

In order to obtain consistent properties along the ribbon length it is advantageous to perform the annealing with a feedback control. For this purpose the magnetic properties (e.g. the hysteresis loop) are measured after the ribbon has exited the furnace and the annealing parameters are adjusted if the resulting test parameter deviates from a predetermined value. This is preferably done by adjusting the level of the applied tensile stress, i.e. the tension is increased or decreased to yield the desired magnetic properties. This feedback system is capable of effectively compensating the influence of composition fluctuations, thickness fluctuations and deviations in the annealing time and temperature on the magnetic and magnetoelastic properties. The result are extremely consistent and reproducible properties of the annealed ribbon, which otherwise are subject to relatively strong fluctuations due to the afore-mentioned influences.

In order to correlate the measurement on a continuous ribbon with the resonator properties it is essential to correct the parameters for demagnetizing effects as they occur on the short resonator assembly. As an example, consistent resonator properties for a dual resonator are achieved when the sum of the anisotropy field of the continuous ribbon plus twice the demagnetizing field of a single resonator piece is kept at a constant, predetermined value, which preferably lies between about 8 Oe to 12 Oe.

In another embodiment of the present invention, more than two ribbon pieces are arranged in registration to form a multiple resonator, e.g. a triple resonator. Such a multiple resonator has the advantage that it produces even higher signal amplitudes. A generalized formula for the alloy compositions which, when annealed as described above, produce a multiple (i.e. at least triple) resonator having suitable properties for use in a marker in a electronic article identification system, is as follows:

$$Fe_aCo_bNi_cSi_xB_yM_z$$

wherein a, b, c, x, y and z are in at %, wherein M is one or more glass formation promoting element such as C, P, Ge, Nb, Ta and/or Mo and/or one or more transition metals such as Cr and/or Mn and wherein $30 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$.

such that a+b+c+x+y+z=100.

In a preferred embodiment the anisotropy of the amorphous alloy ribbon is controlled by applying a tensile stress during annealing with the following refined ranges in the above formula:

$45 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$ Examples for such alloys particularly suited for a 6 mm wide and a 35 mm to 40 mm long triple resonator are:

$$Fe_{46}Co_2Ni_{35}Si_1B_{15.5}C_{0.5} \text{ and } Fe_{51}Co_2Ni_{30}Si_1B_{15.5}C_{0.5}$$

A particularly suited example for a 6 mm wide resonator assembly consisting of 4 resonator pieces (about 35 to 40 mm long) is given by the composition $Fe_{53}Ni_{30}Si_1B_{15.5}C_{0.5}$.

In general, the following compositions are preferred with respect to optimization of the silicon and boron content, and are also optimal for manufacturing ovens used by the Assignee (Vacuumschmelze GmbH) using an annealing process making simultaneous use of a perpendicular field and tensile stress, and these alloys are also the most promising candidates for further reducing the cobalt content. These preferred compositions are $Fe_{24}Co_{13}Ni_{45.5}Si_{1.5}B_{16}$, $Fe_{24}Co_{12.5}Ni_{45.5}Si_2B_{16}$, $Fe_{24}Co_{12.5}Ni_{45}Si_2B_{16.5}$, $Fe_{24}Co_{11.5}Ni_{46.5}Si_{1.5}B_{16.5}$, $Fe_{24}Co_{10.5}Ni_{48}Si_2B_{15.5}$, $Fe_{25}Co_{10}Ni_{47}Si_2B_{16}$, $Fe_{24}Co_{9.5}Ni_{49.5}Si_{1.5}B_{15.5}$ and $Fe_{24}Co_{8.5}Ni_{51}Si_1B_{15.5}$.

Lastly, it should be noted that typically as a result of ingot preparation, the resulting alloy in practice will contain carbon in an amount of up to about 0.5 at %, and correspondingly less boron.

DESCRIPTION OF THE DRAWINGS

FIG. 9 is a graph showing respective curves for the resonant frequency $F_r$ versus the bias field H for two alloys (single resonator piece) annealed in accordance with the principles of the present invention for use in a dual resonator assembly, but having respectively different saturation magnetostriction constants $\lambda_s$.

FIG. 10 illustrates amplitude enhancement which is achieved by annealing a resonator piece having a composition in accordance with the principles of the present invention in a magnetic field oriented substantially perpendicularly to the ribbon axis and to the ribbon plane, compared to conventional transverse annealing in a magnetic field which is oriented substantially perpendicularly to the ribbon axis and parallel to the ribbon plane, i.e., across the ribbon width.

PREFERRED EMBODIMENTS OF THE INVENTION

Alloy Preparation

Figure 1A:
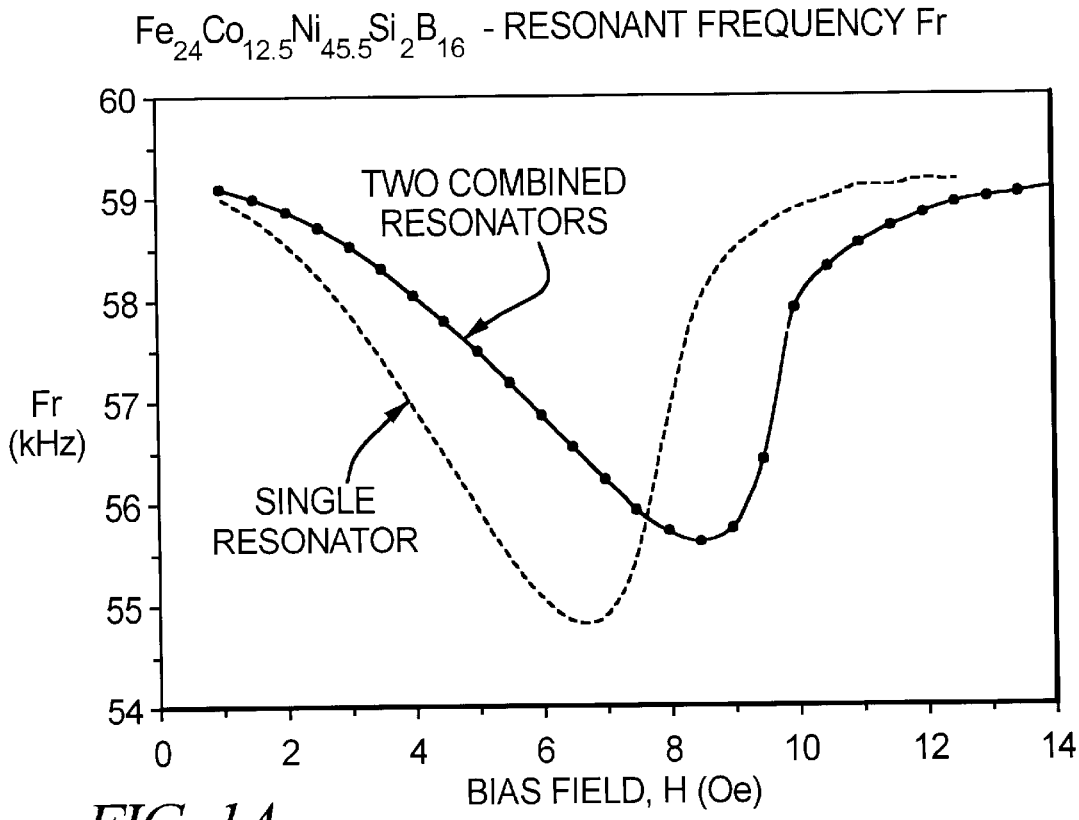
FIG. 1A is a graph showing the resonant frequency $F_r$ versus the bias field H for a single resonator marker and a marker having two combined resonators in accordance with the invention, made of the same ribbon having a composition of $Fe_{24}Co_{12.5}Ni_{45.5}Si_2B_{16}$, annealed at a speed of 25 m/min. at 355° C. and a tensile strength of about 80 MPa.

Amorphous metal alloys within the Fe—Co—Ni—Si—B system were prepared by rapidly quenching from the melt as thin ribbons typically 25 $\mu$m thick. Table I lists typical examples of the investigated compositions and their basic magnetic properties. The compositions are nominal only and the individual concentrations may deviate slightly from this nominal values and the alloy may contain impurities like carbon (as for C typically up to about 1 at %) due to the melting process and the purity of the raw materials.

All casts were prepared from ingots of at least 3 kg using commercially available raw materials. The ribbons used for the experiments were 6 mm wide (except for alloy No. 2 where the width was 12.7 mm) and were either directly cast to their final width or slit from wider ribbons. The ribbons were strong, hard and ductile and had a shiny top surface and a somewhat less shiny bottom surface.

Annealing

The ribbons were annealed in a continuous mode by transporting the alloy ribbon from one reel to another reel through an oven in which a magnetic field was applied perpendicularly to the long ribbon axis.

The magnetic field was oriented transverse to the ribbon axis, i.e. across the ribbon width according to the teachings of the prior art or, alternatively, the magnetic field was oriented such that it had a substantial component perpendicular to the ribbon plane. The latter technique is disclosed in the aforementioned co-pending U.S. application Ser. No. 08/890,612, and provides the advantages of higher signal amplitudes. In both cases (transverse and perpendicular) the annealing field is perpendicular to the long ribbon axis.

The magnetic field was produced in a 2.80 m long yoke by permanent magnets. Its strength was about 2.8 kOe in the experiments where the field was oriented essentially perpendicular to the ribbon plane and about 1 kOe in the set-up for "transverse" field annealing.

Although the majority of the examples given in the following were obtained with the annealing field oriented essentially perpendicular due the ribbon plane, the major conclusions apply as well to the conventional "transverse" annealing which also was tested.

The annealing was performed in ambient atmosphere. The annealing temperature was chosen within the range from about 300° C. to about 420° C. A lower limit for the annealing temperature is about 300° C. which is necessary to relieve part of the production-inherent stresses and to provide sufficient thermal energy in order to induce a magnetic anisotropy. An upper limit for the annealing temperature results from the Curie temperature and the crystallization temperature. Another upper limit for the annealing temperature results from the requirement that the ribbon be ductile enough after the heat treatment to be cut to short strips. The highest annealing temperature should be preferably lower than the lowest of the material characteristic temperatures. Thus, typically, the upper limit of the annealing temperature is around 420° C.

The furnace used for the experiments was about 2.40 m long with a hot zone of about 1.80 m in length wherein the ribbon was subjected to the aforementioned annealing temperature. The annealing speeds typically ranged from about 5 m/min to about 30 m/min, which correspond to annealing times from 22 sec down to about 4 sec, respectively.

The ribbon was transported through the oven in a straight path and was supported by an elongated annealing fixture in order to avoid bending or twisting of the ribbon due to the forces and the torque exerted on the ribbon by the magnetic field.

The annealing was performed with a tension feedback control which allows the magnetic properties to be set to a predetermined value (provided a proper choice of the alloy composition). This technique is disclosed in detail in the aforementioned co-pending U.S. application Ser. No. 08/968,653.

Testing

The annealed ribbon was cut to short pieces typically 38 mm long. These samples (a "sample" means a single ribbon piece or several ribbon pieces put together) were used to measure the hysteresis loop and the magneto-elastic properties.

The hysteresis loop was measured at a frequency of 60 Hz in a sinusoidal field of about 30 Oe peak amplitude. The anisotropy field is defined as the magnetic field $H_k$ at which the magnetization reached its saturation value. For an easy axis across the ribbon width the transverse anisotropy field is related to anisotropy constant $K_u$ by $$H_k=2K_u/J_s$$

where $J_s$ is the saturation magnetization. $K_u$ is the energy needed per volume unit to rotate the magnetization vector from the direction parallel to the magnetic easy axis to a direction perpendicular to the easy axis. It should be noted that $H_k$ depends not only on the alloy composition and heat treatment but, due to demagnetizing effects also depends on the length, width and thickness of the samples.

The magneto-acoustic properties such as the resonant frequency Fr and the resonant amplitude A1 were determined as a function of a superimposed dc bias field H along the ribbon axis by exciting longitudinal resonant vibrations with tone bursts of a small alternating magnetic field oscillating at the resonant frequency with a peak amplitude of about 18 mOe. The on-time of the burst was about 1.6 ms with a pause of about 18 ms in between the bursts.

The resonant frequency of the longitudinal mechanical vibration of an elongated strip is given by $$F_r = \frac{1}{2L}\sqrt{E_H/\rho}$$

where L is the sample length, $E_H$ is Young's modulus at the bias field H and ρ is the mass density. For the 38 mm long samples the resonant frequency typically was in between about 50 kHz and 60 kHz depending on the bias field strength.

The mechanical stress associated with the mechanical vibration, via magnetoelastic interaction, produces a periodic change of the magnetization J around its average value $J_H$ determined by the bias field H. The associated change of magnetic flux induces an electromagnetic force (emf), which was measured in a close-coupled pickup coil around the ribbon with about 100 turns.

In EAS systems the magneto-acoustic response of the marker is advantageously detected in between the tone bursts which reduces the noise level and, thus, for example allows for wider gates (the excitation and reception coils being respectively disposed in the spaced-apart vertical sides of a gate). The signal decays exponentially after the excitation i.e. when the tone burst is over. The decay time depends on the alloy composition and the heat treatment and may range from about a few hundred microseconds up to several milliseconds. A sufficiently long decay time of at least about 1 ms is important to provide sufficient signal identity in between the tone bursts.

Therefore the induced resonant signal amplitude was measured about 1 ms after the excitation; this resonant signal amplitude will be referred to as A1 in the following. A high A1 amplitude as measured here, thus, is an indication of both a good magneto-acoustic response and low signal attenuation.

Results

Conventional markers for EAS use a single resonator which is about 38 mm long, about 25 μm and about 12.7 mm or 6 mm wide. Examples 1 and 2a in Table II represent two such conventional compositions and their magnetic and resonant properties suitable for EAS applications.

Obviously the wider resonator has about twice the signal amplitude of the narrow ribbon. Yet, the clear advantage of the narrow ribbon is that it allows to build a narrower i.e. a leaner marker. It is highly desirable to combine the advantages of the narrow and the wide resonator, i.e. to provide a narrow marker with high signal amplitude.

The difference in the signal amplitude between the conventional wide and narrow resonator material (examples 1 and 2a in Table II) obviously is related to the ribbon's cross-section in each case. A higher cross-section appears to give a higher resonant signal amplitude.

In a first experiment the signal amplitude of the narrow ribbon was attempted to be increased by increasing the ribbon's thickness, resulting in a larger cross-section. The ribbon was annealed in the same manner as in example 2a. The results of this experiment are listed as example 2b in Table II. Despite of the larger cross-section, the signal amplitude decreased, which is interpreted in terms of the eddy current losses associated with the larger ribbon thickness.

In a second experiment two ribbon pieces of alloy No. 2 were arranged in registration to form a dual resonator. The ribbon was annealed in the same manner as in example 2a. As a result the resonant amplitude A1 significantly increased (example 2c in Table II). The surface features of the ribbons (like e.g. thin oxide layers) guarantee sufficient electrical insulation between the ribbons so as to suppress the penetration of eddy currents between the two ribbons. Yet, the amplitude still proved to be significantly lower than for the 12.7 mm wide ribbon piece. Moreover, the frequency shift ΔFr upon decreasing the bias from 6.5 Oe to 2 Oe was reduced to only about 1.2 kHz, which is not sufficient to guarantee a reliable deactivability of the marker.

Figure 1B:
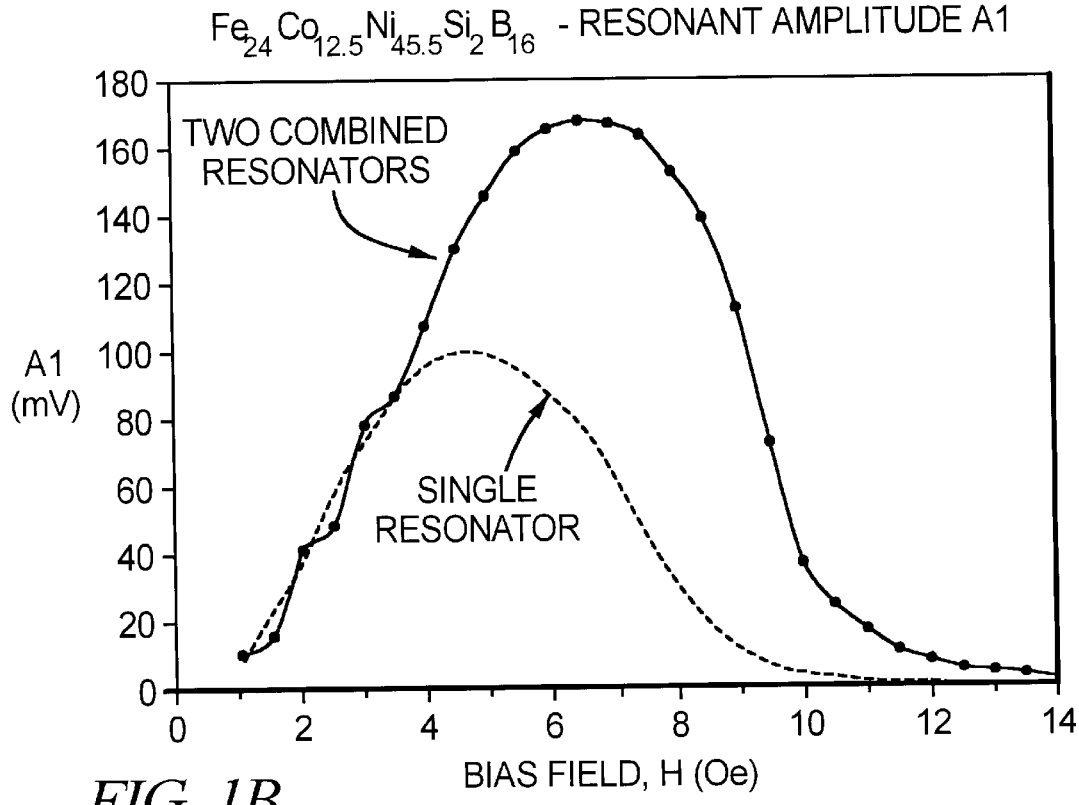
FIG. 1B is a graph showing the resonant amplitude A1 versus the bias field H for a single resonator marker and a marker having two combined resonators in accordance with the invention, made of the same ribbon having a composition of $Fe_{24}Co_{12.5}Ni_{45.5}Si_2B_{16}$, annealed at a speed of 25 m/min. at 355° C. and a tensile strength of about 80 MPa.

In further experiments, the alloy composition was changed from the conventional compositions by reducing the Co-content of the alloy. The 6 mm ribbon was then annealed similarly to the foregoing examples. Again two pieces of the 6 mm wide ribbon were put together to form a dual resonator. The results are shown in Table III (examples 3 through 9) and represent a preferred embodiment of this invention. As an example, the resonant properties (frequency in FIG. 1A and amplitude in FIG. 1B) and the hysteresis loop (FIG. 2) of example 3 are shown which are comparable to the 12.7 mm wide resonator of example 1, in particular the high signal amplitude. The narrower ribbon, combined to a dual resonator, however, now permits a much narrower marker to be used.

Figure 2:
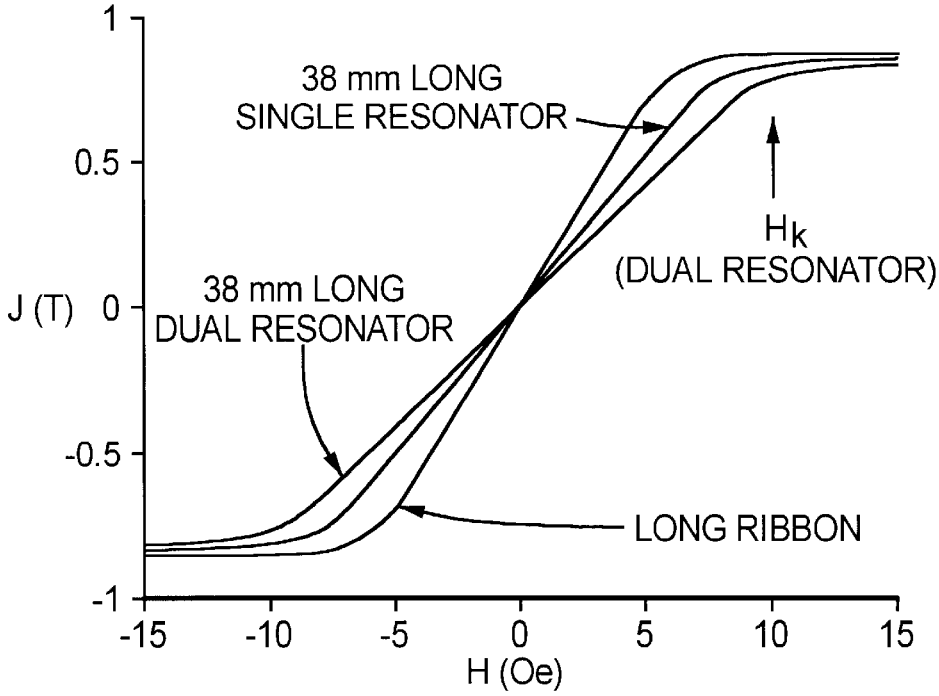
FIG. 2 shows respective hysteresis loops for a 38 mm long dual resonator, a 38 mm long single resonator, and a long ribbon, having the same composition and annealed under the same conditions as the example shown in FIG. 1.

As can be seen from FIG. 2, the anisotropy (or knee) field $H_k$, which is defined as the field at which the hysteresis loop approaches saturation, increases in the following sequence: $H_k$ (long ribbon)<$H_k$ (signal resonator of 38 mm length)<$H_k$ (dual resonator of 38 mm length).

Figure 3A:
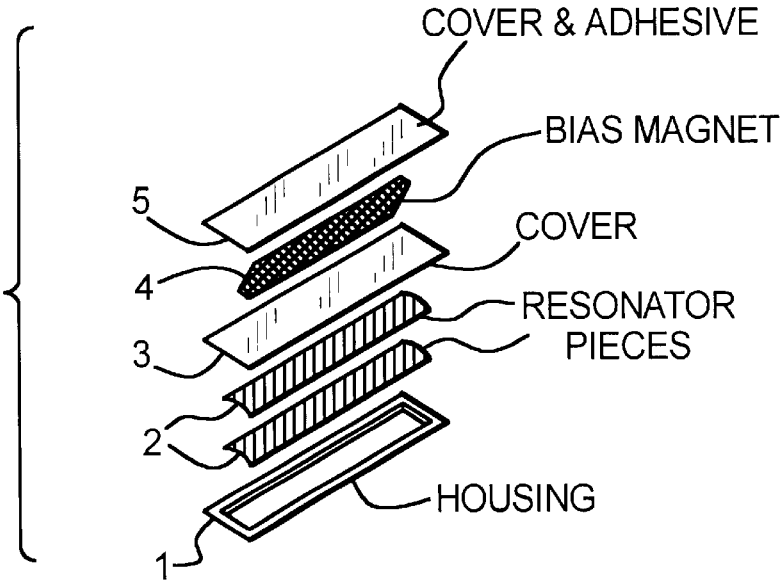
FIG. 3A is an exploded view of the components of a magneto-acoustic marker constructed and manufactured in accordance with the principles of the present invention, having narrow (6 mm wide) resonator pieces.
Figure 3B:
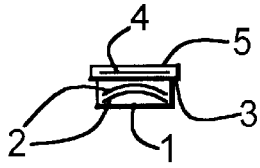
FIG. 3B is an end view of the inventive magneto-acoustic marker shown in FIG. 3A.

FIGS. 3A and 3B illustrate the basic components, and the structural arrangement of those components, in an embodiment of a dual resonator marker constructed in accordance with the invention. The inventive marker includes a narrow housing 1, which contains two resonator pieces 2 each having a width of 6 mm. The resonator pieces 2 are overlaid with a first cover 3, on which a bias magnet 4 is placed. The bias magnet 4 is overlaid with a second cover and adhesive 5, so as to close the housing 1 to contain all components therein.

Figure 4A:
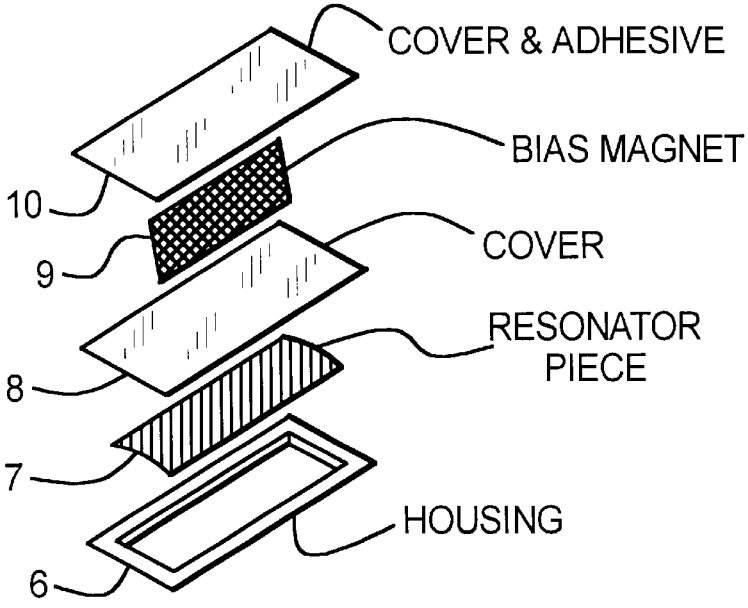
FIG. 4A (PRIOR ART)
FIG. 4A is an exploded view of a conventional magneto-acoustic marker having a wide (12.7 mm) resonator piece.
Figure 4B:
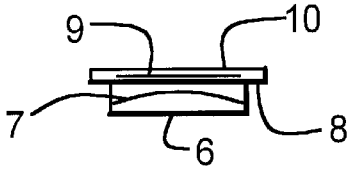
FIG. 4B (PRIOR ART)
FIG. 4B is an end view of the conventional magneto-acoustic marker shown in FIG. 4A.

The basic structure and components of a conventional (wide) magneto-acoustic marker are shown in FIGS. 4A and 4B. This conventional marker includes a housing 6, which is wide enough to accommodate a conventional wide (12.7 mm) resonator piece 7, overlaid by a first cover 8. A bias magnet 9 is placed on the first cover 8, and is overlaid by a second cover and adhesive 10.

The inventive marker of FIGS. 3A and 3B and the conventional wide marker of FIGS. 4A and 4B have the same performance, however, the inventive marker with the dual resonator has clear cosmetic and cost advantages due its smaller width. As also shown in FIGS. 3A and 3B, it is advantageous that the resonator pieces 2 have a transverse curl (typically of about 150 μm to 320 μm) with a top oriented toward the bias magnet. Such a curl can be annealed in by an appropriate annealing fixture (cf. the aforementioned co-pending U.S. application Ser. No. 08/968,653.

It should be added that the required properties can also be achieved e.g. with alloy No. 2 by annealing it at higher temperatures of about 420° C. Since this is not far from the upper limit of annealing temperatures, Alloys Nos. 3 through 9 are preferred since they allow lower annealing temperatures (typically 350° C. to 380° C.) which reduces the risk of embrittlement and/or crystallization.

In order to explain the above findings, it should first be noted that the resonant frequency $F_r$ can be described reasonably well as a function of the bias field H by $$F_r(H) = \frac{1}{2L}\sqrt{\frac{E_s/\rho}{1+\frac{9\lambda_s^2 E_s}{J_s H_K^3}H^2}}$$

where $\lambda_s$ is the saturation magnetostriction constant, $J_s$ is the saturation magnetization, $E_s$ is Young's modulus in the ferromagnetically saturated state, $H_K$ is the knee field of the hysteresis loop, ρ is the mass density and L is the resonator length.

One crucial parameter which determines the resonator properties thus is the knee field $H_K$ of the hysteresis loop. It is important to recognize that the knee field $H_K$ relevant to the above relation not only depends on the thermally induced anisotropy field (a widespread common belief) but also essentially on the geometry (length, width, thickness) of the ribbon pieces and the number of ribbon pieces which form the actual resonator assembly. Accordingly $H_K$ can be approximately described by $$H_k = H_A + p\ N\ J_s/\mu_O$$

where $H_A$ is the thermally induced anisotropy field (=the knee field, $H_K$, recorded on a very long piece of ribbon), p is the number of ribbon pieces for the resonator assembly and N is the demagnetizing factor of a single ribbon piece ($\mu_0$ is vacuum permeability and $J_s$ is the saturation magnetization).

The mass density π, Young's modulus $E_s$, the saturation magnetostriction $\lambda_s$ and the saturation magnetization $J_s$ mainly depend on the alloy composition. The induced anisotropy field $H_A$ depends both on alloy composition and heat treatment. The effective resonator knee field $H_K$ additionally depends on resonator geometry and the number of resonators due to demagnetizing effects. Accordingly, in order to obtain an optimized resonator for an EAS marker, a well defined combination of alloy composition, heat treatment and resonator geometry, is required.

Thus, the proper choice of $H_K$ for a given alloy composition is crucial to give the marker the desired properties i.e. high amplitude, insensitivity to the fluctuations in the bias field and good deactivability. A value of $H_K$, which is too high e.g. yields a bad deactivability, too low a value of $H_K$ which results in a slope of the $F_r$ vs. bias curve which is too high.

Figure 5:
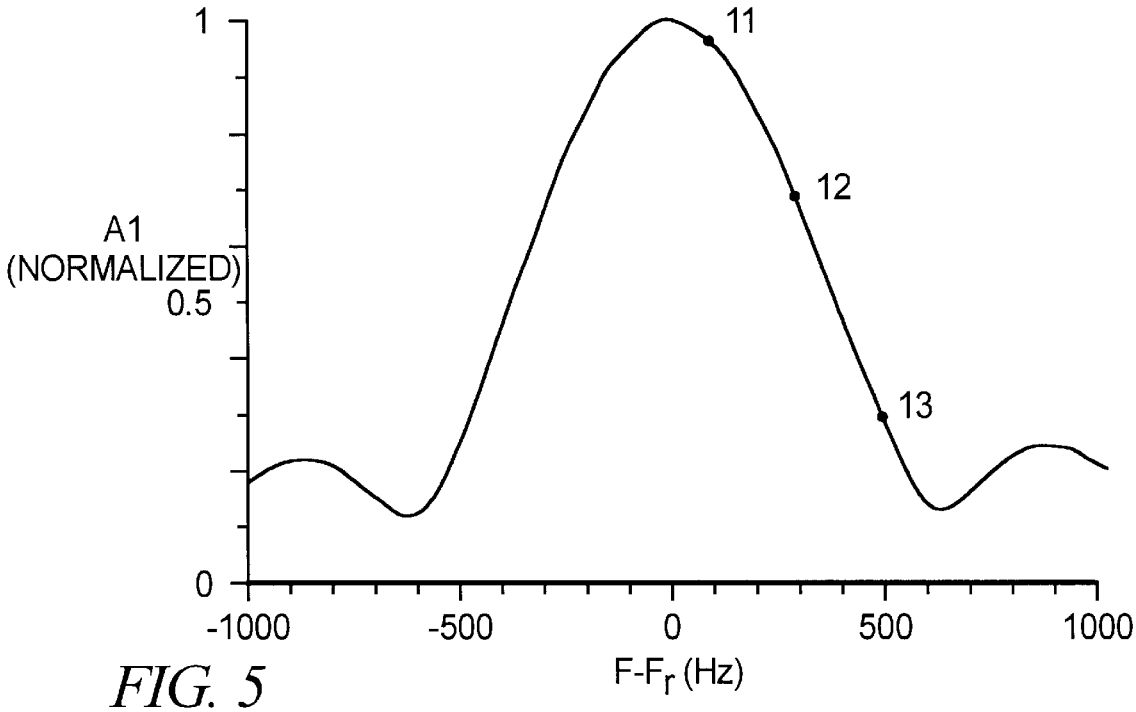
FIG. 5 is a graph showing the resonant amplitude A1 as a function of the difference between the frequency F of the exciting AC field and the resonant frequency $F_r$ of the resonator assembly, in a magneto-acoustic marker constructed and manufactured in accordance with the principles of the present invention.

As an example, FIG. 5 illustrates the behavior of the signal amplitude when the resonant frequency $F_r$ shifts away from the exciting frequency in the interrogating zone due to a slight offset of the bias field of about 0.5 Oe from its target value, e.g. due to a different orientation in earth's magnetic field. The solid circle 11 indicates $|dF_r/dH| \cong 200$ Hz/Oe, the solid circle 12 represents $|dF_r/dH| \cong 600$ Hz/Oe, and the solid circle 13 indicates $|dF_r/dH| \cong = 1{,}000$ Hz/Oe. It can be concluded from FIG. 5 that if the slope $|dF_r/dH|$ is too high, i.e. more than about 750 Hz/Oe the signal amplitude drops by more than 50%, which reduces the pick-rate (i.e. correct alarm-producing rate) significantly and the marker loses its signal identity.

As a result of the above-discussed investigations, a few conclusions to guide the choice of particular well-suited alloy compositions as given in Tables I and III can be positioned as follows $H_k$ should have a value around about 10 Oe, which ensures that the maximum amplitude occurs at bias fields below about 8 Oe. In order to obtain suitable resonator properties (i.e. a low enough slope and a high enough $F_r$-shift upon deactivation) appropriate of the resonator assembly the alloy should then have a magnetostriction around about 8 to 14 ppm. This is achieved for alloy compositions with an iron content less than about 30 at %. The iron content should be at least about 15 at % in order for the material to have a high enough magnetostriction so as to be excitable magneto-elastically.

In order to achieve the desired value of $H_k$ by typical heat treatments (i.e. a few seconds at temperatures between about 300° C. and 420° C.), the Co- and Ni-content have to be chosen correspondingly. This limits the Co and the Ni-content to the ranges given in the Summary section above. Thus, e.g., for a 6 mm wide dual resonator, alloys with Co-content higher than 18 at % produce a value of the required frequency shift $\Delta F_r$ which is too small and alloys with a Co-content less than about 6 at % exhibit a frequency slope $|dF_r/dH|$ which is too high (too steep).

In order to make use of the tension feedback control, the anisotropy field must be sufficiently sensitive to the application of a tensile stress during annealing. This is only the case for alloy compositions with an iron content of either less than about 30 at % or more than about 45 at %.

It is also possible to combine more than two resonator pieces to achieve even higher amplitudes. Examples are given in Table IV. For such triple or tertiary resonators it is advantageous to further reduce the Co-content of the alloy. Such low Co-content alloys suitable for these multiple resonators are not suitable for the dual resonator. Dual resonators made of such alloys always showed an undesirably high slope of round about 1000 Hz/Oe, which makes the resonator too sensitive to changes in the bias field.

One key point associated with the successful production of dual and multiple resonators, thus, was to recognize that for an optimized multiple resonator marker it is essential to have the effective $H_k$ of the total resonator assembly at a well defined value. Accordingly, given a certain composition, this effective $H_k$ value has to be always about the same, regardless of use as a single, dual or multiple resonator, provided $H_k$ refers in each case to the actual resonator assembly. Yet, having e.g. an optimized dual resonator, the $H_k$ of the individual ribbon pieces forming this resonator is smaller (e.g. by about 2 Oe for a 6 mm wide ribbon) than that of the whole assembly (see FIGS. 3A, 3B and 4A, 4B). As a consequence, a single resonator made out of the same material exhibits different magneto-acoustic properties than the dual resonator (cf. FIGS. 1A, 1B). Thus, generally, an amorphous alloy ribbon optimally annealed for a dual resonator generally is less suitable or not suitable for a single resonator, and vice versa.

Principally, a given alloy can be optimized for use as a single, dual or multiple resonator by different annealing treatments i.e., for example, by adjusting the annealing temperature, time and the tension used during annealing. Yet, in practice the variability of the resonator properties by annealing is limited. In order to guarantee a robust annealing treatment, an optimized dual (multiple) resonator, therefore, will generally require a somewhat different composition than an optimized single resonator (assuming the same width and length of the resonator pieces). Thus, compared to an optimized single resonator, an optimized dual resonator in general needs a composition with a smaller Co-content and/or a higher (Si, B, C, Ni)-content (although the differences may only be 1 at % or less).

Figure 6:
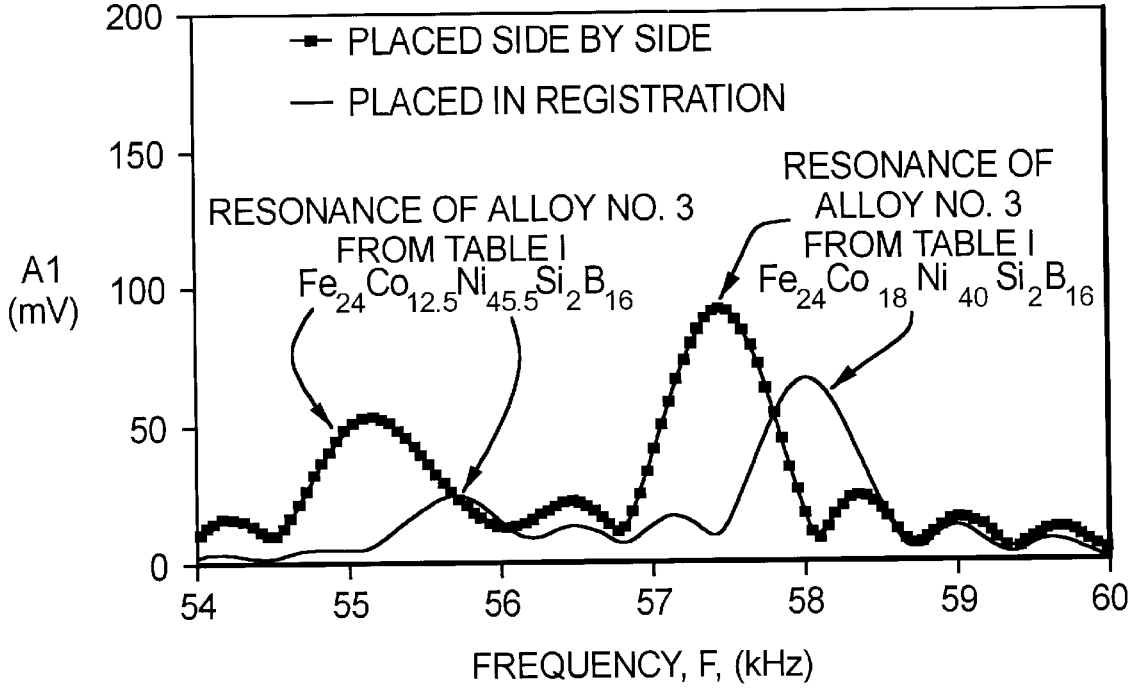
FIG. 6 is a graph showing amplitude versus exciting frequency for a dual resonator consisting of two narrow (6 mm wide) resonator pieces having respectively different alloy compositions, and thus respectively different individual resonant frequencies at a given bias field, in a side-by-side arrangement and in an arrangement wherein the resonator pieces are in registration.
Figure 7:
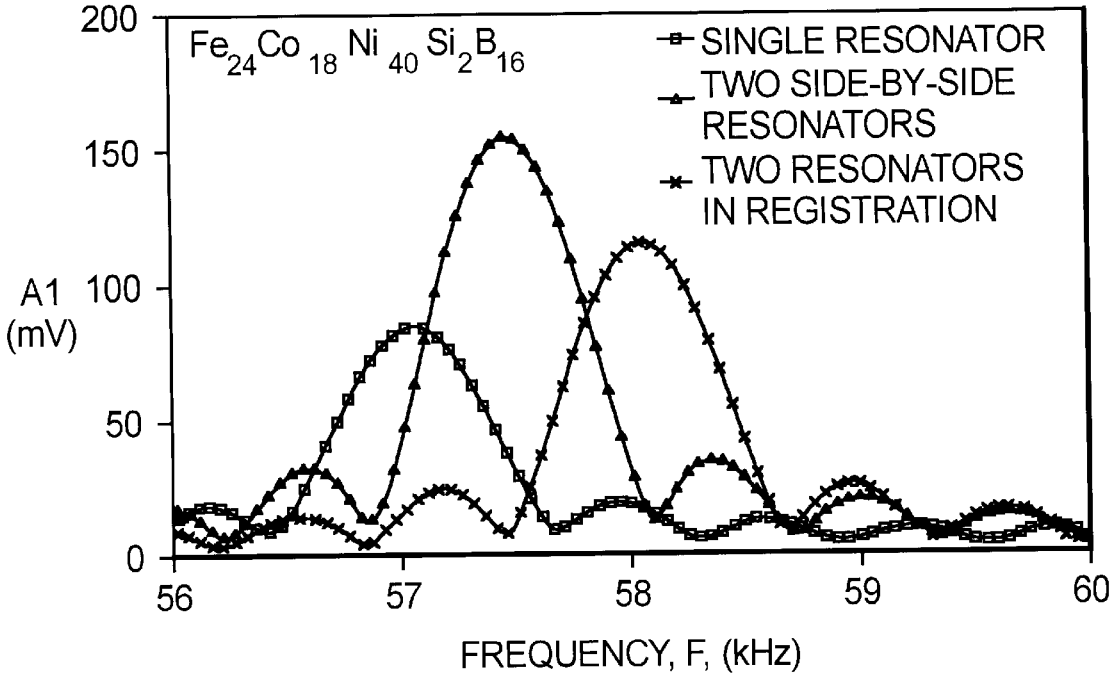
FIG. 7 is a graph showing amplitude versus exciting frequency for a dual resonator consisting of two narrow (6 mm wide) resonator pieces of the same alloy composition (alloy no. 2 of Table I herein), and thus with identical individual resonant frequencies at a given bias field, in a side-by-side configuration, and in a configuration wherein the resonator pieces are in registration and, for reference, showing the individual curve of a single resonator of this alloy.
Figure 8:
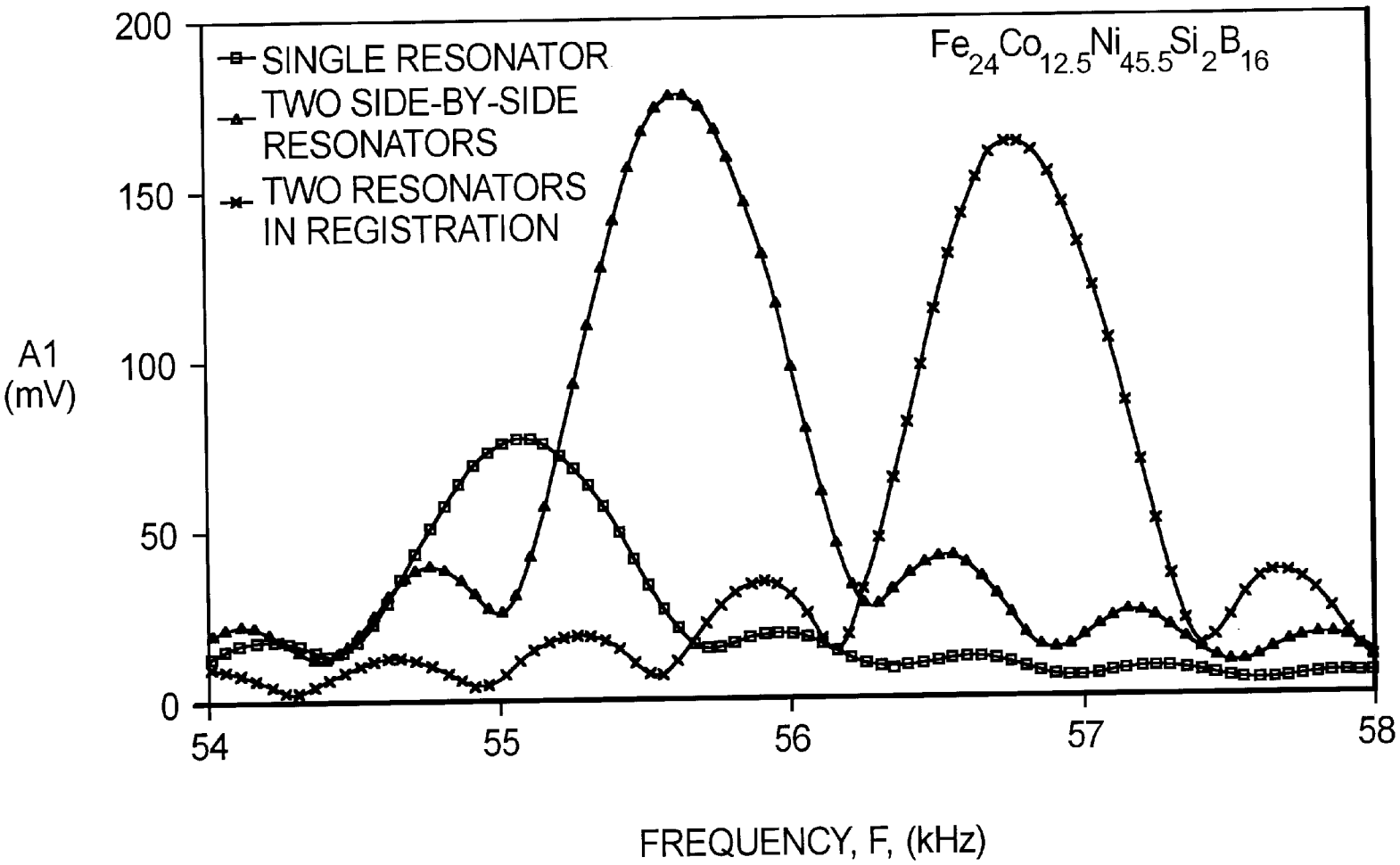
FIG. 8 is a graph showing amplitude versus exciting frequency for a dual resonator consisting of two narrow (6 mm wide) resonator pieces of the same alloy composition (alloy no. 3 of Table I herein), and thus with identical individual resonant frequencies at a given bias field, in a side-by-side configuration, and in a configuration wherein the resonator pieces are in registration and, for reference, showing the individual curve of a single resonator of this alloy.

FIGS. 6, 7 and 8 demonstrate the advantages which are obtained by placing multiple resonator pieces in registration, as opposed to the conventional side-by-side arrangement exemplified by the aforementioned U.S. Pat. No. 4,510,490.

As noted above, the primary reason for using two resonators in the marker described in U.S. Pat. No. 4,510,490 is to be able to employ resonators with respectively different resonant frequencies at a given bias field, so as to give the marker a unique identity. FIGS. 6, 7 and 8 demonstrate that placing two resonator pieces in registration (on top of each other) is not magnetically equivalent to arranging two resonator pieces side-by-side.

FIG. 6 compares the signal amplitude of a dual resonator consisting of two resonators of different alloy compositions, hence having respectively different resonant frequencies at a given bias field H=6.5 Oe, arranged in a side-by-side relationship and arranged in registration. The alloy numbers refer to Table I herein. Alloy no. 2 in that Table has a composition $Fe_{24}Co_{18}Ni_{40}Si_2B_{16}$, and alloy no. 3 from that Table has a composition $Fe_{24}Co_{12.5}Ni_{45.5}Si_2B_{16}$. As is clearly evident from FIG. 6, for these types of resonators which each have different individual resonant frequencies not in accordance with the present invention, it is advantageous to place the ribbon side-by-side, because the amplitude drops significantly if the ribbons are placed in registration.

FIG. 7 shows a dual resonator consisting of two individual resonator pieces, but the individual pieces were optimized for use as a single resonator, and correspond to alloy no. 2 of Table 1 herein. These two resonator pieces have nominally identical resonant frequencies at a bias field H=6.5 Oe. As can be seen from FIG. 7, again the amplitude drops significantly if these resonators are placed in registration, instead of side-by-side. Moreover, it can be seen from FIG. 7 that the dual resonator formed by placing the ribbons in registration shows an insufficient frequency change $\Delta F_r$ when the bias is removed (i.e., when the marker is deactivated) and additionally has a disadvantageously high Q. These results are summarized in the following Table A1:

Table A1: Alloy Nr 2 of Table I (prior art and comparative examples)

| Resonator Type | A1 (mV) | Q | $F_r$ (kHz) | $\lvert dF_r/dH \rvert$ (Hz/Oe) | $\Delta F_r$ (kHz) |
|---|---|---|---|---|---|
| Single Nr. 1 | 84 | 505 | 57.02 | 630 | 2.21 |
| Single Nr. 2 | 87 | 495 | 57.00 | 663 | 2.31 |
| Dual side by side | 154 | 628 | 57.47 | 569 | 1.88 |
| Dual on top of each other | 115 | 984 | 58.08 | 410 | 1.32 |

FIG. 8 shows a dual resonator according to the principles of the present invention, the properties being summarized in Table A2 below. As can be seen from FIG. 8, due to the inventive alloy and heat treatment, the amplitude of the dual resonator with two resonator pieces in registration shows only a minor decrease in amplitude, and also fulfills the other requirements relating to slope, $\Delta F_r$, Q, etc. for a good marker. Again, a bias field H=6.5 Oe was used.

The resonator pieces for which results are shown in FIGS. 6, 7 and 8 were all 6 mm wide, 38 mm long and 25 $\mu$m thick.

Table A2: Alloy Nr 3 of Table I (inventive example)

| Resonator Type | A1 (mV) | Q | $F_r$ (kHz) | $\lvert dF_r/dH \rvert$ (Hz/Oe) | $\Delta F_r$ (kHz) |
|---|---|---|---|---|---|
| Single Nr. 1 | 75 | 223 | 55.02 | 193 | 3.53 |
| Single Nr. 2 | 75 | 223 | 55.04 | 235 | 3.56 |

-continued

| Resonator Type | A1 (mV) | Q | $F_r$ (kHz) | $\lvert dF_r/dH \rvert$ (Hz/Oe) | $\Delta F_r$ (kHz) |
|---|---|---|---|---|---|
| Dual side by side | 176 | 301 | 55.67 | 677 | 3.03 |
| Dual on top of each other | 163 | 508 | 56.79 | 581 | 2.09 |

Particular Examples Suitable for Both a Dual and a Single Resonator

As already demonstrated by the examples in Table II and as discussed above a resonator alloy optimized for a single resonator (cf. example 2) in general has inferior properties if used as a dual (multiple) resonator (cf. example 2c), and vice versa.

Thus, typically, an alloy ribbon optimized for a dual (multiple) resonator, if used as a single resonator has a slope of about $\lvert dF_r/dH \rvert \cong 1000$ Hz/Oe, which is too high. The latter means that the sensitivity of the resonant frequency with respect to accidental fluctuations of the bias field strength (due to scatter of the bias magnet and/or orientation of the marker with respect to the earth's magnetic field) will be too high, which is unsuitable for a good marker, since the resonant frequency provides the marker with signal identity.

An example (example 9b) is given in Table V which shows the single resonator properties of Alloy No. 9 (cf. Tables I, III) which was optimally annealed for a dual resonator. The slope $\lvert dF_r/dH \rvert$ of this single resonator is almost 900 Hz/Oe and, thus, is clearly higher than acceptable. Similarly, Table V illustrates that the triple resonator examples 10 through 11 have unfavorable single resonator properties (high slope and low amplitude).

The present inventor has nevertheless found that there are exceptions from this generalization, which are limited to a particular compositional range and to a particular heat treatments, as represented by alloys Nos. 3 through 8 in Table I and the examples Nos. 3 to 8 in Table III, which where optimally annealed for a dual resonator. As illustrated by the examples 3b, 5b and 7b in Table V, these particular ribbons simultaneously exhibit suitable properties for use as a single resonator, although having been optimally annealed for a dual resonator. The properties are not only comparable to a 6 mm single resonator of the prior art, but even tend to be advantageous because of the lower slope $\lvert dF_r/dH \rvert$ and the higher frequency shift $\Delta F_r$.

The significantly lower slope enhances the pick-rate for the marker because the resonant frequency is less sensitive to fluctuations of the bias field. This insensitivity is equivalent to a tag with higher amplitude but higher slope, because the amplitude decreases if the resonant frequency deviates from frequency of the exciting AC magnetic field. In other words a marker with a lower slope exhibits a higher signal amplitude and, thus, is better detected by the interrogating system if the exciting frequency does not exactly match the resonant frequency than compared to a marker with a higher slope (cf. FIG. 5).

Secondly, the significantly higher $\Delta F_r$ provides even more assurance that there will be no false alarms if the deactivation of the marker is poor due to an imperfect degaussing of the bias magnet.

Accordingly these particular single resonators are even more suitable for a marker than single resonator of the prior art such as e.g. example 2a in Table II.

The fact that these particular annealed alloy ribbons (examples 3 through 8 in Tables I and III ) can be used for a dual as well as for a single resonator tag is a further advantage since this circumstance facilitates the logistics in producing both types of markers if required. Thus, examples 3 to 8 in Tables I and III are a most preferred embodiment of this invention.

Another key point of this invention, thus, is the discovery that it is possible to make a particular choice of alloy composition and/or annealing treatment to provide narrow amorphous alloy ribbon suitable both for a single resonator and dual resonator.

This finding is illustrated in FIG. 9. FIG. 9 is a graph of the resonant frequency versus bias field curve for two alloys optimally annealed for use as a dual resonator but with different saturation magnetostriction constants $\Delta_s$. More precisely, FIG. 9 shows the resonant frequency curve for a single ribbon pieces, i.e. for a single resonator. The dashed vertical lines show the range of a typical bias field produced by the magnet 4 (and 9).

The alloy with the higher magnetostriction ($\lambda_s$=15 ppm) requires a higher anisotropy field $H_k$ than the alloy with the lower magnetostriction ($\lambda_s$=11 ppm) in order to have the same performance as a dual resonator. As a consequence the minimum of the resonant frequency for the high magnetostrictive alloy is located at a higher bias field of about 9 Oe, whereas the minimum of the resonant frequency for the lower magnetostrictive alloy is located at lower bias field of about 7 Oe, which coincides with the typical bias fields suitable for application.

A bias field which is too high is unsuitable because of the magnetic attractive force between the bias magnet and the resonator which leads to undesirable clamping and, thus, loss in signal. Thus, a bias field of less then about 8 Oe is preferred.

Consequently, at typical bias fields of 6 to 7 Oe, the high magnetostrictive single resonator has a slope of about 1000 Hz/Oe which is unsuitable, while the lower magnetostrictive alloy has a rather low slope because the magnetic bias field almost coincides with the minimum of the resonant frequency curve, i.e. with $|d_{Fr}/dH|\approx 0$.

Accordingly, it is preferable to have an alloy composition with a saturation magnetostriction of less then about 15 ppm, which is achievable if the iron content of the alloy is less than about 30 at %. Thus, for example, alloys with an iron content of about 24 at % typically exhibit a saturation magnetostriction constant $\lambda_s$ of about 10 ppm to 12 ppm, which is suitable to have the minimum of the resonant frequency close to a bias field of about 6 Oe to 7 Oe.

This explains why alloy 9 (27 at % Fe, $\lambda_s\approx$13 ppm) due to its higher magnetostriction is less suited as a single resonator than alloys No. 3 through 8 (24 at % Fe, $\lambda_s\approx$11–12 ppm) if the bias is about 6 to 7 Oe and if the annealed ribbon should simultaneously be suitable for a dual resonator marker. Correspondingly, the situation becomes worse for the higher magnetostrictive alloys (cf. alloys 10–12 with $\lambda_s$>20 ppm) where the ribbons optimized for a multiple resonator exhibit a slope far over 1000 Hz/Oe and a low amplitude if used as a single resonator.

Accordingly, some guidelines derived from the above investigation, for an annealed alloy ribbon which is suitable both for a dual resonator and a single resonator are as follows.

The bias field where the resonant frequency of the single resonator has a minimum should almost coincide with the magnetic bias field produced by the bias magnet which typically should be less than about 8 Oe and preferably be about 6 to 7 Oe. Simultaneously the bias field where the amplitude A1 of the dual resonator has its maximum should be close to this bias field where the resonant frequency of the single resonator has a minimum.

Accordingly, the annealing treatment has to be chosen such that the knee field $H_k$ of the single resonator is somewhat (i.e. by about 10–30%) above the applied bias field. This is achieved by annealing the alloy at a temperature between about 300° C. and 400° C. for a time period of a few seconds in the presence of a magnetic field oriented essentially perpendicularly to the ribbon axis and, as an option, with the simultaneous application of a tensile stress up to about 200 MPa. The applied magnetic field must be oriented also essentially perpendicular to the ribbon plane, such that annealing produces a fine domain structure oriented across the ribbon width with an average domain width which is smaller than (approximately) the ribbon thickness.

The alloy composition has to be chosen such that the induced anisotropy field is capable of producing suitable resonator properties for a dual resonator.

The latter is achieved by choosing e.g. an alloy composition which exhibits a magnetostriction close to about 10–12 ppm. This is achieved by choosing a Fe—Co—Ni—Si—B alloy with a iron content between about 22 at % and about 26 at %, a Co content between about 8 at % and 14 at %, a Ni-content between about 44 at % and about 52 at % and a combined content of glass forming elements (Si, B, C, Nb, Mo, etc) which is at least about 15 at % and less than 20 at %. Such a particular choice is preferable for a marker operating at a bias of about 6 to 7 Oe.

If the marker operates at lower bias fields than about 6 Oe, the magnetostriction has to be reduced further and the composition has to be adjusted accordingly, e.g. toward lower iron contents down to an admissible lower limit of about 15 at %. Such modifications also are necessary if the slope of the dual resonator itself has to be reduced further without decreasing $\Delta F_r$, which can be done by biasing the dual resonator at its minimum of the resonant frequency. Although in the latter case the suitability for simultaneous use as a single resonator might be lost, such an alternative dual resonator with an alloy of lower magnetostriction provides the advantage of a reduced frequency sensitivity to fluctuations of the bias and is another embodiment of this invention.

It should be noted that the annealing perpendicular to the ribbon plane is crucial to achieving a significant amplitude level at the minimum of the resonant frequency. It also enhances the maximum amplitude level by at least about 10–20%. Conventional transverse field annealed material exhibits an almost vanishing signal amplitude at the bias field where the resonant frequency has a minimum, and therefore is not suited for these preferred embodiments of the invention. The situation is illustrated in FIG. 10.

If the simultaneous suitability as a single and dual resonator is not a requirement, the perpendicular field annealing is a preferable option, but not a necessity. The range of alloy composition then is somewhat wider, but the iron content should also be below about 30 at % in order to ensure that the maximum signal amplitude is located at moderate bias levels such that a bias field below about 8 Oe produces a high enough signal amplitude.

Tables

Notations for the Tables:

- $H_K$ anisotropy field of the resonator assembly
- A1 resonator amplitude at a bias of 6.5 Oe
- $|df_r/dH|$ is the slope, i.e. sensitivity of the resonant frequency $F_r$ to changes of the bias field (which is at 6.5 Oe in these examples)
- $\Delta F_r$ is the frequency shift, i.e. the difference of the resonant frequency between bias fields of 2 Oe and 6.5

Oe, which is a measure for the change of frequency required for deactivation of the marker

TABLE I

Tested alloy compositions. $J_s$ is the saturation magnetization, $\lambda_s$ is the saturation magnetostriction constant.

| | Composition in at % | | | | | $J_s$ | $\lambda_s$ |
|---|---|---|---|---|---|---|---|
| Alloy Nr | Fe | Co | Ni | Si | B | (T) | (ppm) |
| 1 | 24 | 16 | 42.5 | 1.5 | 16 | 0.93 | 11.7 |
| 2 | 24 | 18 | 40 | 2 | 16 | 0.95 | 11.7 |
| 3 | 24 | 12.5 | 45.5 | 2 | 16 | 0.86 | 11.4 |
| 4 | 24 | 12.5 | 44.5 | 2 | 17 | 0.84 | 11.0 |
| 5 | 24 | 13 | 45.5 | 1.5 | 16 | 0.89 | 11.4 |
| 6 | 24 | 12 | 46.5 | 1.5 | 16 | 0.87 | 11.2 |
| 7 | 24 | 11.5 | 47 | 1.5 | 16 | 0.88 | 11.3 |
| 8 | 24 | 11 | 48 | 1 | 16 | 0.88 | 11.4 |
| 9 | 27 | 10 | 45 | 2 | 16 | 0.91 | 12.9 |
| 10 | 46 | 2 | 35 | 1 | 16 | 1.22 | 24.2 |
| 11 | 51 | 2 | 30 | 1 | 16 | 1.32 | 28.0 |
| 12 | 0 | 53 | 30 | 1 | 16 | 1.33 | 28.6 |

TABLE II

State of the art (example 1 and 2a) and comparative examples. (Typical annealing parameters: several seconds at an annealing temperatures of about 390° C., tensile stress between about 80 and 120 MPa)

| Example | Alloy Nr | Type | Width (mm) | Thick (pm) | $H_k$ (Oe) | A1 (mV) | \|dFr/dH\| (Hz/Oe) | $\Delta F_r$ (kHz) |
|---|---|---|---|---|---|---|---|---|
| 1 | 1 | single | 12.7 | 25 | 10.5 | 165 | 601 | 2.08 |
| 2a | 2 | single | 6 | 25 | 10.5 | 85 | 605 | 2.11 |
| 2b | 2 | single | 6 | 40 | 11.7 | 67 | 466 | 1.63 |
| 2c | 2 | dual | 6 | 25 | 12.3 | 107 | 317 | 1.21 |

TABLE III

Inventive examples for 6 mm wide, 25 $\mu$m thick and 35 mm to 40 mm long dual resonators. (Typical annealing parameters: several seconds at annealing temperatures between about 350° C. and 390° C., tensile stress between about 80 and 120 MPa)

| Example | Alloy Nr | Type | $H_k$ (Oe) | A1 (mV) | \|dFr/dH\| (Hz/Oe) | $DF_r$ (kHz) |
|---|---|---|---|---|---|---|
| 3 | 3 | dual | 9.9 | 167 | 622 | 2.32 |
| 4 | 4 | dual | 10.0 | 160 | 581 | 2.15 |
| 5 | 5 | dual | 9.5 | 162 | 597 | 2.17 |
| 6 | 6 | dual | 9.6 | 158 | 629 | 2.24 |
| 7 | 7 | dual | 9.9 | 166 | 620 | 2.21 |
| 8 | 8 | dual | 10.0 | 150 | 555 | 1.98 |
| 9 | 9 | dual | 10.5 | 161 | 667 | 2.30 |

TABLE IV

Inventive examples for 6 mm wide, 25 $\mu$m thick and 35 mm to 40 mm long multiple (>2) resonators. (Typical annealing parameters: about 6s at annealing temperatures between about 350° C. and 390° C., tensile stress between about 80 and 120 MPa)

| Example | Alloy Nr | Type | $H_k$ (Oe) | A1 (mV) | \|dFr/dH\| (Hz/Oe) | $DF_r$ (kHz) |
|---|---|---|---|---|---|---|
| 10 | 10 | triple | 15.2 | 181 | 597 | 1.90 |
| 11 | 11 | triple | 16.3 | 191 | 599 | 1.99 |
| 12 | 12 | 4 | 17.8 | 212 | 515 | 1.89 |

TABLE V

Typical resonator properties of single resonators using the material optimized for a dual (or multiple) resonator (c.f. examples Tables III and IV).

| Example | Alloy Nr | Type | $H_k$ (Oe) | A1 (mV) | \|dFr/dH\| (Hz/Oe) | $DF_r$ (kHz) |
|---|---|---|---|---|---|---|
| 3b | 3 | single | 8.0 | 78 | 214 | 3.73 |
| 5b | 5 | single | 7.7 | 72 | 281 | 3.46 |
| 7b | 7 | single | 7.8 | 70 | 42 | 3.61 |
| 9b | 9 | single | 8.7 | 83 | 894 | 3.90 |
| 10b | 10 | single | 11.4 | 49 | 1386 | 5.52 |
| 11b | 11 | single | 12.4 | 55 | 1448 | 5.80 |

Although various changes and modifications to the presently preferred embodiments described herein will be apparent to those skilled in the art, such changes and modifications can be made without departing from the spirit and scope of the present invention and without diminishing its attendant advantages. Therefore, the appended claims are intended to cover such changes and modifications.

I claim:

1. A method for making a resonator for use in a marker containing a bias element, which produces a bias magnetic field, in a magnetomechanical electronic article surveillance system, said method comprising the steps of:

providing a planar ferromagnetic ribbon comprising an alloy with an iron content of at least about 15 at %, said ferromagnetic ribbon having a ribbon axis extending along a longest dimension of ferromagnetic ribbon;

annealing said ferromagnetic ribbon while subjecting said ferromagnetic ribbon to at least one of a magnetic field oriented perpendicularly to said ribbon axis and a tensile stress applied along said ribbon axis, to produce an annealed ferromagnetic ribbon;

cutting pieces from said ferromagnetic ribbon respectively having substantially equal lengths and substantially equal widths, said pieces respectively having individual resonant frequencies in said magnetic field coinciding to within +/−500 Hz; and disposing at least two of said pieces in registration to form a multiple resonator.

2. A method as claimed in claim 1 wherein the step of providing a planar ferromagnetic ribbon comprises providing a ferromagnetic ribbon having a cobalt content of less than about 18 at % and a nickel content of at least about 25 at %.

3. A method as claimed in claim 1 wherein said ferromagnetic ribbon has a ribbon plane containing said ribbon axis, and wherein the step of annealing said ferromagnetic ribbon comprises annealing said ferromagnetic ribbon in a magnetic field having a substantial component normal to said plane.

4. A method as claimed in claim 3 wherein the step of annealing said ferromagnetic ribbon comprises annealing said ferromagnetic ribbon in a magnetic field having, in addition to said substantial component normal to said plane, a component in said plane and transverse to said ribbon axis and a smallest component along said ferromagnetic ribbon for producing a fine domain structure in said ferromagnetic ribbon regularly oriented transversely to said ribbon axis.

5. A method as claimed in claim 1 wherein the step of annealing said ferromagnetic ribbon comprises annealing said ferromagnetic ribbon in a magnetic field having a strength of at least about 800 Oe while applying a tensile strength to said ferromagnetic ribbon in a range between about 50 to about 150 MPa, with an annealing speed of said ferromagnetic ribbon in a range between about 15 to about 50 m/min, and at an annealing temperature in a range between about 300° C. to about 400° C.

6. A method as claimed in claim 5 wherein the step of annealing said ferromagnetic ribbon comprises annealing said ferromagnetic ribbon in a magnetic field having a strength of at least about 2,000 Oe.

7. A method as claimed in claim 1 wherein step the of annealing said ferromagnetic ribbon comprises annealing said ferromagnetic ribbon to produce a hysteresis loop in said pieces, when cut from said annealed ferromagnetic ribbon, which is linear up to a magnetic field at which said alloy is ferromagnetically saturated.

8. A method as claimed in claim 1 wherein said ferromagnetic ribbon has a ribbon thickness and wherein the step of annealing said ferromagnetic ribbon comprises annealing said ferromagnetic ribbon to produce a fine domain structure in said ferromagnetic ribbon having a domain width which is less than said ribbon thickness.

9. A method as claimed in claim 1 comprising selecting a composition of said alloy to produce, in each of said pieces, a saturation magnetostriction in a range between about 8 and about 14 ppm and an anisotropy field $H_k$ of said multiple resonator in a range between about 8 and about 12 Oe.

10. A method as claimed in claim 9 comprising selecting said composition of said alloy to give said multiple resonator a stable resonant frequency $F_r$ wherein $|dF_r/dH|<750$ Hz/Oe, wherein H represents said bias magnetic field, and wherein $F_r$ changes by at least 1.6 kHz when said bias magnetic field is removed.

11. A method as claimed in claim 1 wherein the step of providing a planar ferromagnetic ribbon comprises providing an amorphous ribbon having a composition $Fe_aCo_bNi_cSi_xB_yM_z$, wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $15 \leqq a \leqq 30$ $6 \leqq b \leqq 18$ $27 \leqq c \leqq 55$ $0 \leqq x \leqq 10$ $10 \leqq y \leqq 25$ $0 \leqq z \leqq 5$ $14 \leqq x+y+z \leqq 25$ such that $a+b+c+x+y+z=100$.

12. A method as claimed in claim 11 wherein the step of providing a planar ferromagnetic ribbon comprises providing said planar amorphous ribbon wherein $20 \leqq a \leqq 28$ $6 \leqq b \leqq 14$ $40 \leqq c \leqq 55$ $0.5 \leqq x \leqq 5$ $12 \leqq y \leqq 18$ $0 \leqq z \leqq 2$ $15<x+y+z<20$.

13. A method as claimed in claim 1 wherein the step of cutting pieces from said annealed ferromagnetic ribbon comprises cutting pieces from said ferromagnetic ribbon each having a width in a range between about 4 to about 8 mm, a length in a range between about 35 to about 40 mm, and a thickness in a range between about 20 to about 30.

14. A method as claimed in claim 13 wherein the step of providing a planar ferromagnetic ribbon comprises providing an amorphous ferromagnetic ribbon having a composition selected from the group of compositions consisting of $Fe_{22}Co_{10}Ni_{50}Si_2B_{16}$, $Fe_{22}Co_{12.5}Ni_{47.5}Si_2B_{16}$, $Fe_{24}Co_{13}Ni_{45.5}Si_{1.5}B_{16}$, $Fe_{24}Co_{12.5}Ni_{45.5}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$ and $Fe_{27}Co_{10}Ni_{45}Si_2B_{16}$.

15. A method as claimed in claim 13 wherein the step of providing a planar ferromagnetic ribbon comprises providing a planar ferromagnetic amorphous ribbon having a composition according to the formula $$Fe_{24-r}Co_{12.5-w}Ni_{45+r+v+1.5w}Si_{2+u}B_{16.5-u-v-0.5w}$$

wherein r=−4 to 4 at %, u=−1 to 1, v=−1 to 1 and w=−1 to 4 at %.

16. A method as claimed in claim 1 wherein the step of cutting pieces from said annealed ferromagnetic ribbon comprises cutting a plurality of consecutive pieces along said ribbon axis from said ferromagnetic ribbon and wherein the step of disposing at least two of said pieces in registration comprises disposing at least two of said consecutively cut pieces in registration to form said multiple resonator.

17. A method as claimed in claim 1 wherein the step of disposing at least two of said pieces in registration comprises disposing at least three of said pieces in registration, and wherein the step of providing a planar ferromagnetic ribbon comprises providing a planar amorphous ribbon having a composition $Fe_aCo_bNi_cSi_xB_yM_z$, wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $30 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$ such that $a+b+c+x+y+z=100$.

18. A method as claimed in claim 17 wherein the step of providing a planar ferromagnetic ribbon comprises providing a planar amorphous ribbon wherein $45 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$.

19. A method as claimed in claim 17 wherein the step of cutting said pieces from said annealed ferromagnetic ribbon comprises cutting pieces from said ferromagnetic ribbon each having a width of about 6 mm and a length in a range between about 35 to about 40 mm, and wherein the step of providing a planar amorphous ribbon comprises providing a planar amorphous ribbon having a composition $Fe_{46}Co_2Ni_{35}Si_1B_{15.5}C_{0.5}$.

20. A method as claimed in claim 17 wherein the step of cutting said pieces from said annealed ferromagnetic ribbon comprises cutting pieces from said ferromagnetic ribbon each having a width of about 6 mm and a length in a range between about 35 to about 40 mm, and wherein the step of providing a planar amorphous ribbon comprises providing a planar amorphous ribbon having a composition $Fe_{51}Co_2Ni_{30}Si_1B,_{15.5}CO_{0.5}$.

21. A method as claimed in claim 1 wherein the step of disposing at least two of said pieces in registration comprises disposing four of said pieces in registration to form said multiple resonator, and wherein the step of providing a planar ferromagnetic ribbon comprises providing a planar amorphous ribbon having a composition $Fe_{53}Ni_{30}Si_1B_{15.5}C_{0.5}$.

22. A method for making a resonator for use in a marker containing a bias element, which produces a bias magnetic field, in a magnetomechanical electronic article surveillance system, said method comprising the steps of:

providing a planar ferromagnetic amorphous ribbon having a ribbon axis extending along a longest dimension of said ferromagnetic amorphous ribbon and having a composition $Fe_aCo_bNi_cSi_xB_yM_z$ wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $22 \leqq a \leqq 26$ $8 \leqq b \leqq 14$ $44 \leqq c \leqq 52$ $0.5 \leqq x \leqq 5$ $12 \leqq y \leqq 18$ $0 \leqq z \leqq 2$ $15 < x+y+z < 20$ such that $a+b+c+x+y+z=100$;

annealing said ferromagnetic amorphous ribbon while subjecting said ferromagnetic amorphous ribbon to at least one of a magnetic field oriented perpendicularly to said ribbon axis and a tensile stress applied along said ribbon axis, to produce an annealed ferromagnetic amorphous ribbon;

cutting pieces from said ferromagnetic amorphous ribbon respectively having substantially equal lengths and substantially each widths, said pieces respectively having individual resonant frequencies in said magnetic field coinciding to within +/−500 Hz; and disposing a number of said pieces in registration selected from the group consisting of one piece and two pieces, to form a resonator.

23. A method as claimed in claim 22 wherein the step of cutting pieces from said annealed ferromagnetic amorphous ribbon comprises cutting pieces from said annealed ferromagnetic amorphous ribbon each having a width in a range between about 4 to about 8 mm and a length in a range between about 35 to about 40 mm.

24. A method as claimed in claim 23 wherein the step of providing a planar ferromagnetic amorphous ribbon comprises providing a planar ferromagnetic amorphous ribbon having a composition selected from the group of compositions consisting of:

$Fe_{24}Co_{13}Ni_{45.5}Si_{1.5}B_{16}$, $Fe_{24}Co_{12.5}Ni_{45}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16.5}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$.

25. A method as claimed in claim 23 wherein the step of providing a planar ferromagnetic amorphous ribbon comprises providing a planar ferromagnetic amorphous ribbon comprising an alloy having the formula $$Fe_{24-r}Co_{12.5-w}Ni_{45+r+v+1.5w}Si_{2+u}B_{16.5-u-v-0.5w}$$

wherein r=−1 to 1 at %, u=−1 to 1, v=−1 to 1 and w=−1 to 4 at %.

26. A multiple resonator for use in a marker containing a bias element, which produces a bias magnetic field, in a magnetomechanical electronic article surveillance system, said resonator comprising:

at least two ferromagnetic elements disposed in registration each having a length and a width and the respective widths of said at least two ferromagnetic elements being substantially equal and the respective lengths of said at least two ferromagnetic elements being substantially equal, and each of said at least two ferromagnetic elements having a ribbon axis oriented perpendicularly to, and in a plane with, said width, and having a thickness;

each of said ferromagnetic elements comprising an alloy with an iron content of at least about 15 at %;

all of said ferromagnetic elements having respective resonant frequencies in said magnetic field which coincide to within +/−500 Hz, a hysteresis loop which is linear up to a magnetic field at which said alloy is ferromagnetically saturated, and a fine domain structure having a domain width which is less than said thickness.

27. A multiple resonator as claimed in claim 26 wherein each of said ferromagnetic elements comprises an alloy with a cobalt content of less than about 18 at % and a nickel content of at least about 25 at %.

28. A multiple resonator as claimed in claim 26 wherein each of said ferromagnetic elements has a saturation magnetostriction in a range between about 8 and about 14 ppm and wherein said multiple resonator has an anisotropy field $H_k$ in a range between about 8 and about 12 Oe.

29. A multiple resonator as claimed in claim 26 having a stable resonant frequency $F_r$ wherein $|dF_r/dH|<750$ Hz/Oe, wherein H represents said bias magnetic field, and wherein $F_r$ changes by at least 1.6 kHz when said bias magnetic field is removed.

30. A multiple resonator as claimed in claim 26 wherein each of said ferromagnetic elements comprises providing an amorphous ribbon having a composition $Fe_aCo_bNi_cSi_xB_yM_z$, wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $15 \leqq a \leqq 30$ $6 \leqq b \leqq 18$ $27 \leqq c \leqq 55$ $0 \leqq x \leqq 10$ $10 \leqq y \leqq 25$ $0 \leqq z \leqq 5$ $14 \leqq x+y+z \leqq 25$ such that $a+b+c+x+y+z=100$.

31. A multiple resonator as claimed in claim 30 wherein each of said ferromagnetic elements comprises an amorphous element wherein $20 \leqq a \leqq 28$ $6 \leqq b \leqq 14$ $40 \leqq c \leqq 55$ $0.5 \leqq x \leqq 5$ $12 \leqq y \leqq 18$ $0 \leqq z \leqq 2$ $15 < x+y+z < 20$.

32. A multiple resonator as claimed in claim 26 wherein each of said ferromagnetic elements has said width in a range between about 4 to about 8 mm, a length along said element axis in a range between about 35 to about 40 mm, and said thickness in a range between about 20 to about 30 μm.

33. A multiple resonator as claimed in claim 26 wherein each of said ferromagnetic elements has a composition selected from the group of compositions consisting of: $Fe_{22}Co_{10}Ni_{50}Si_2B_{16}$, $Fe_{22}Co_{12.5}Ni_{47.5}Si_2B_{16}$, $Fe_{24}Co_{13}Ni_{45.5}Si_{1.5}B_{16}$, $Fe_{24}Co_{12.5}Ni_{45.5}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$ and $Fe_{27}Co_{10}Ni_{45}Si_2B_{16}$.

34. A multiple resonator as claimed in claim 26 wherein each of said ferromagnetic elements has a composition according to the formula $$Fe_{24-r}Co_{12.5-w}Ni_{45+r+v+1.5w}Si_{2+u}B_{16.5-u-v-0.5w}$$

wherein r=−4 to 4 at %, u=−1 to 1, v=−1 to 1 and w=−1 to 4 at %.

35. A multiple resonator as claimed in claim 32 wherein each of said ferromagnetic elements has a composition selected from the group of compositions consisting of $Fe_{24}Co_{13}Ni_{45.5}Si_{1.5}B_{16}$, $Fe_{24}Co_{12.5}Ni_{45}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16.5}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$.

36. A multiple resonator as claimed in claim 32 wherein each of said ferromagnetic elements has a composition according to the formula $$Fe_{24-r}Co_{12.5-w}Ni_{45+r+v+1.5w}Si_{2+u}B_{16.5-u-v-0.5w}$$

wherein r=−1 to 1 at %, u=−1 to 1, v=−1 to 1 and w=−1 to 4 at %.

37. A multiple resonator as claimed in claim 26 comprising two and only two of said elements in registration.

38. A multiple resonator as claimed in claim 26 comprising at least three of said elements in registration, and wherein each of said ferromagnetic elements has a composition $Fe_aCo_bNi_cSi_xB_yM_z$, wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $30 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$ such that a+b+c+x+y+z=100.

39. A multiple resonator as claimed in claim 38 wherein each of said ferromagnetic elements comprises an amorphous element wherein $45 \leqq a \leqq 65$ $0 \leqq b \leqq 6$ $25 \leqq c \leqq 50$ $0 \leqq x \leqq 10$ $10 \leqq y \leqq 25$ $0 \leqq z \leqq 5$ $15 \leqq x+y+z \leqq 25$.

40. A multiple resonator as claimed in claim 39 comprising three and only three of said ferromagnetic elements and wherein each of said amorphous elements has a width of about 6 mm and a length in a range between about 35 to about 40 mm, and wherein each of said amorphous elements has a composition $Fe_{46}Co_2Ni_{35}Si_1B_{15.5}C_{0.5}$.

41. A multiple resonator as claimed in claim 39 comprising three and only three of said ferromagnetic elements and wherein each of said amorphous elements has a width of about 6 mm and a length in a range between about 35 to about 40 mm, and wherein each of said amorphous elements has a composition $Fe_{51}Co_2Ni_{30}Si_1B_{15.5}C_{0.5}$.

42. A multiple resonator as claimed in claim 26 comprising four and only four of said ferromagnetic elements in registration, and wherein each of said ferromagnetic elements comprises an amorphous element having a composition $Fe_{53}Ni_{30}Si_1B_{15.5}C_{0.5}$.

43. A dual resonator for use in a marker containing a bias element, which produces a bias magnetic field, in a magnetomechanical electronic article surveillance system, said resonator comprising:

two and only two ferromagnetic elements disposed in registration, each of said two ferromagnetic elements having a width and a length, with the respective widths of said two ferromagnetic elements being substantially equal and the respective lengths of said two ferromagnetic elements being substantially equal, and each of said two ferromagnetic elements having a ribbon axis oriented perpendicularly to, and in a plane with, said width, and each of said two ferromagnetic elements having a thickness;

each of said two ferromagnetic elements having a composition $Fe_aCo_bNi_cSi_xB_yM_z$ wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $22 \leqq a \leqq 26$ $8 \leqq b \leqq 14$ $44 \leqq c \leqq 52$ $0.5 \leqq x \leqq 5$ $12 \leqq y$ 18

$0 \leqq z \leqq 2$ $15 < x+y+z < 20$ such that a+b+c+x+y+z=100;

all of said ferromagnetic elements having respective resonant frequencies in said magnetic field which coincide to within +/−500 Hz, a hysteresis loop which is linear up to a magnetic field at which said ferromagnetic element is ferromagnetically saturated, and a fine domain structure having a domain width which is less than said thickness.

44. A dual resonator as claimed in claim 43 wherein each of said ferromagnetic elements has said width in a range between about 4 to about 8 mm, a length along said element axis in a range between about 35 to about 40 mm, and said thickness in a range between about 20 to about 30 $\mu$m.

45. A dual resonator as claimed in claim 44 wherein each of said ferromagnetic elements has a composition selected from the group of compositions consisting of $Fe_{24}Co_{13}Ni_{45.5}Si_{1.5}B_{16}$, $Fe_{24}Co_{12.5}Ni_{45}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16.5}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$.

46. A dual resonator as claimed in claim 44 wherein each of said ferromagnetic elements has a composition according to the formula $$Fe_{24-r}Co_{12.5-w}Ni_{45+r+v+1.5w}Si_{2+u}B_{16.5-u-v-0.5w}$$

wherein r=−1 to at %, u=−1 to 1, v=−1 to 1 and w=−1 to 4 at %.

47. A single resonator for use in a marker containing a bias element, which produces a bias magnetic field, in a magnetomechanical electronic article surveillance system, said resonator comprising:

a single ferromagnetic element having a width of less than about 13 mm and a ribbon axis oriented perpendicularly to, and in a plane with, said width, and having a thickness;

said single ferromagnetic element having a composition $Fe_aCo_bNi_cSi_xB_yM_z$ wherein a, b, c, x, y and z are in at %, wherein M is at least one glass formation promoting element selected from the group consisting of C, P, Ge, Nb, Ta and Mo and/or at least one transition metal selected from the group consisting of Cr and Mn, and wherein $22 \leqq a \leqq 6$ $8 \leqq b \leqq 14$ $44 \leqq c \leqq 52$ $0.5 \leqq x \leqq 5$ $12 \leqq y \leqq 18$ $0 \leqq z \leqq 2$ $15 < x+y+z < 20$ such that a+b+c+x+y+z=100;

said single ferromagnetic element having respective resonant frequencies in said magnetic field which coincide to within +/−500 Hz, a hysteresis loop which is linear up to a magnetic field at which said ferromagnet element is ferromagnetically saturated, and a fine domain structure having a domain width which is less than said thickness.

48. A single resonator as claimed in claim 47 wherein said single ferromagnetic element comprises a planar ferromagnetic element has a composition selected from the group of compositions consisting of: $Fe_{24}Co_{13}Ni_{45.5}Si_{1.5}B_{16}$, $Fe_{24}Co_{12.5}Ni_{45}Si_{1.5}B_{17}$, $Fe_{24}Co_{12.5}Ni_{45.5}Si_2B_{16}$, $Fe_{24}Co_{12.5}Ni_{44.5}Si_2B_{17}$, $Fe_{24}Co_{12.5}Ni_{45}Si_2B_{16.5}$, $Fe_{24}Co_{12.5}Ni_{45}Si_{2.5}B_{16}$, $Fe_{24}Co_{11.5}Ni_{47}Si_{1.5}B_{16}$, $Fe_{24}Co_{11.5}Ni_{46.5}Si_{1.5}B_{16.5}$, $Fe_{24}Co_{11.5}Ni_{46.5}Si_2B_{16}$, $Fe_{24}Co_{11.5}Ni_{46.5}Si_{2.5}B_{15.5}$, $Fe_{24}Co_{11}Ni_{47}Si_1B_{16}$, $Fe_{24}Co_{10.5}Ni_{48}Si_2B_{15.5}$, $Fe_{24}Co_{9.5}Ni_{49.5}Si_{1.5}B_{15.5}$, $Fe_{24}Co_{8.5}Ni_{51}Si_1B_{15.5}$, $Fe_{25}Co_{10}Ni_{47}Si_2B_{16}$.

49. A single resonator as claimed in claim 47 wherein said single ferromagnetic element comprises a planar ferromagnetic element comprising an alloy having the formula $$Fe_{24-r}Co_{12.5-w}Ni_{45+r+v+1.5w}Si_{2+u}B_{16.5-u-v-0.5w}$$

wherein r=−1 to 1 at %, u=−1 to 1, v=−1 to 1 and w=−1 to 4 at %.

* * * * *